US006044162A

United States Patent [19]

Mead et al.

[11] Patent Number: 6,044,162

[45] Date of Patent: Mar. 28, 2000

[54] DIGITAL HEARING AID USING DIFFERENTIAL SIGNAL REPRESENTATIONS

[75] Inventors: Carver A. Mead, Pasadena, Calif.; Douglas M. Chabries, Orem; Keith L. Davis, Salt Lake City, both of Utah

[73] Assignee: Sonic Innovations, Inc., Salt Lake City, Utah

[21] Appl. No.: 08/771,704

[22] Filed: Dec. 20, 1996

[51] Int. Cl.[7] ..... H04R 25/00

[52] U.S. Cl. ..... 381/312; 381/320; 381/321

[58] Field of Search ..... 381/312, 317, 381/318, 320, 321, 98, 106, 111, 116, 117; 364/724.1

[56] References Cited

U.S. PATENT DOCUMENTS

| | | | |
|---|---|---|---|
| 3,234,544 | 2/1966 | Marenholtz | 340/347 |
| 3,298,019 | 1/1967 | Nossen | 340/347 |
| 3,582,947 | 6/1971 | Harrison | 340/347 |
| 3,678,507 | 7/1972 | Rensin | 340/347 DD |
| 3,750,142 | 7/1973 | Barnes et al. | 340/347 |
| 4,210,903 | 7/1980 | LaBrie | 340/347 |
| 4,243,974 | 1/1981 | Mack | 340/347 |
| 4,366,349 | 12/1982 | Adelman | 179/107 FD |
| 4,390,756 | 6/1983 | Hoffmann et al. | 179/107 BC |
| 4,393,275 | 7/1983 | Feldman et al. | 179/1 VL |
| 4,425,481 | 1/1984 | Mansgold et al. | 179/107 FD |
| 4,441,202 | 4/1984 | Tong et al. | 381/68 |
| 4,536,844 | 8/1985 | Lyon | 364/487 |
| 4,545,065 | 10/1985 | Visser | 381/41 |
| 4,548,082 | 10/1985 | Engebretson et al. | 73/585 |
| 4,590,459 | 5/1986 | Lanz et al. | 340/347 AD |
| 4,596,902 | 6/1986 | Gilman | 179/107 FD |
| 4,685,042 | 8/1987 | Severinsky | 363/41 |
| 4,689,819 | 8/1987 | Killion | 381/68 |
| 4,701,958 | 10/1987 | Neth | 381/68 |
| 4,739,511 | 4/1988 | Hori et al. | 381/68 |
| 4,792,977 | 12/1988 | Anderson et al. | 381/68.4 |
| 4,829,270 | 5/1989 | Anderson et al. | 333/14 |
| 4,868,880 | 9/1989 | Bennett, Jr. | 381/68.2 |
| 5,027,306 | 6/1991 | Dattorro et al. | 364/724.1 |
| 5,099,856 | 3/1992 | Killion et al. | 128/731 |
| 5,103,230 | 4/1992 | Kalthoff et al. | 341/166 |
| 5,126,743 | 6/1992 | Hobbs | 341/157 |
| 5,233,665 | 8/1993 | Vaughn et al. | 381/98 |
| 5,241,310 | 8/1993 | Tiemann | 341/143 |
| 5,247,581 | 9/1993 | Gurcan | 381/68.4 |
| 5,276,739 | 1/1994 | Krokstad et al. | 381/68.4 |
| 5,303,346 | 4/1994 | Fesseler et al. | 395/2.39 |
| 5,317,640 | 5/1994 | Callias | 381/68.4 |
| 5,387,875 | 2/1995 | Tateno | 381/68.4 |
| 5,448,644 | 9/1995 | Pfannenmueller et al. | 381/68 |
| 5,495,242 | 2/1996 | Kick et al. | 340/902 |
| 5,500,902 | 3/1996 | Stockharm | 381/68.4 |
| 5,553,152 | 9/1996 | Newton | 381/68.6 |

FOREIGN PATENT DOCUMENTS

| | | | |
|---|---|---|---|
| 0 534 804 | 3/1993 | European Pat. Off. | H03F 3/217 |
| 0 590 903 | 4/1994 | European Pat. Off. | H03F 3/217 |
| 44 41 996 | 11/1994 | Germany | H04R 25/00 |
| 195 45 760 | 12/1995 | Germany | H04R 25/00 |
| 95/08248 | 3/1995 | WIPO | H04R 25/00 |

OTHER PUBLICATIONS

Lee et al., "A Self–Calibrating 15 Bit CMOS A/D Converter", Dec. 1984, IEEE, J. Solid–State Circuits, vol. SC–19, No. 6, pp. 813, 819.

*Primary Examiner*—Huyen Le
*Attorney, Agent, or Firm*—D'Alessandro & Ritchie

[57] ABSTRACT

A hearing compensation system comprises an input transducer for converting acoustical information at an input thereof to electrical signals at an output thereof, a differential analog-to-digital converter sampling the electrical signals output from the input transducer at an input thereof and outputting differential signal samples at an output thereof, a digital signal processing circuit having an input connected to the output of the differential analog-to-digital converter and operating on the differential signal samples to form processed differential signal samples at an output thereof, and an output transducer for converting electrical signals at an input thereof to acoustical information at an output thereof, the processed differential signal samples coupled to the input of the output transducer.

27 Claims, 13 Drawing Sheets

DIGITAL HEARING AID USING DIFFERENTIAL SIGNAL REPRESENTATIONS

BACKGROUND OF THE INVENTION

1. Field of the Invention

The present invention relates to electronic hearing aid devices for use by the hearing impaired and to methods for providing hearing compensation. More particularly, the present invention relates to using differential signal sampling for digital signal processing in such devices and methods.

2. The Prior Art

In conventional hearing aid systems, a hearing aid typically includes an input transducer, a signal processing circuit, and an output transducer. Acoustical energy detected by the input transducer is changed into an electrical signal that is representative of the acoustical energy. To compensate for the hearing deficiencies of the hearing aid user, the signal processing circuit modifies the electrical signal. The signal processing may occur in a single frequency band or in multiple frequency bands and may be either linear or non-linear. The output transducer transduces the processed signal back into acoustical energy for detection by the ear of the hearing aid user.

One manner known in the art to perform the signal processing in the hearing aid is digital signal processing (DSP). Since the output from the input transducer is typically an analog electrical signal, the analog electrical signal is converted to a digital signal by an analog-to-digital (A/D) converter. The precision with which the DSP operations are performed depends generally on two things. First, the precision of the operations themselves, and second, the number of digital bits being output from the A/D converter to represent each digital sample of the signal being fed into the DSP operations. Accordingly, more bits are used to increase the precision of the sample and the accuracy with which the signal can be processed.

In conventional hearing aid systems which employ DSP techniques, the A/D conversion may be implemented using any one of a number of general A/D converters including flash or parallel converters, iterative converters, ramp or staircase converters, tracking converters, integrating converters, and sigma-delta converters followed by an integrator.

The DSP operations are performed on the digital output of the A/D converter representing the full magnitude of the analog input signal. While seeking to have an adequate number of bits for accurate DSP operations, using the smallest number of bits has important advantages. A first advantage is that with fewer bits to process, the energy consumption of the circuits performing the input, output, and the modification of the signal is reduced. A second advantage is that the complexity of the circuits performing the input, the output and the modification of the signal is also reduced. In a hearing aid system, minimizing both the size of the device and the power consumption of the device are important objectives.

It has also been recognized that in individuals with hearing loss, the degree of hearing loss may not be the same across the entire audio spectrum. Accordingly, the audio signal in different frequency bands is digital signal processed in each separate frequency band according to parameters selected to compensate for the hearing loss in that particular frequency band.

The DSP in each frequency band may be either linear or non-linear, however, when the DSP is non-linear, a problem not encountered in linear systems must be addressed. In linear systems, a signal which has been split into several different frequency bands and then linearly digitally processed in each frequency band is summed back together after the DSP according to the law of Linear Superposition.

For non-linear systems it is known that there is no generalized law of Superposition. One approach to providing a rule for superposition in non-linear systems has been set forth by Oppenheim et al, in *Nonlinear Filtering of Multiplied and Convoluted Signals.* Proc. IEE, Vol. 56, pp. 1264–1291, August 1968, which proposed a generalized law of superposition for a class of non-linear systems which can be treated as linear after a transformation. This class of non-linear systems are referred to as homomorphic systems. An example of a homomorphic system can be found in U.S. Pat. No. 5,500,902, wherein a logarithm of the input signal in each frequency band is first taken before additional signal processing is performed on the input signal. The antilog of the processed signal is then taken, and the signals from each frequency band are summed.

It is therefore an object of the present invention to minimize the number of bits in the sampled digital representation of the signal being processed by the hearing aid system.

It is another object of the present invention to minimize the number of bits in the sampled digital representation of the signal by representing the difference between successive analog input signal samples as the sampled digital signal.

It is yet another object of the present invention to use a differential digital signal sample as the digital signal in a multiband hearing aid system.

It is a further object of the present invention to use a differential digital signal sample as the digital signal in a multiband sound processing system.

It is therefore an object of the present invention to implement a multiband hearing aid using a homomorphic transformation in the DSP operations with a differential signal sample representation.

It is another object of the present invention to implement a multiband hearing aid using non-linear DSP operations with differential signal sample representation.

It is a further object of the present invention to implement a multiband sound processing system using non-linear DSP operations with differential signal sample representation.

It is a further object of the present invention to implement a multiband hearing aid using a table look-up for DSP operations with differential signal sample representation.

It is yet another object of the present invention to implement a multiband sound processing system using a table look-up for DSP operations with differential signal sample representation.

It is a further object of the present invention to implement a sound processing system wherein the output transducer is driven by pulses having widths proportional to a differential digital signal.

BRIEF DESCRIPTION OF THE INVENTION

According to a first aspect of the present invention, a hearing compensation system for the hearing impaired employs differential signal sampling and comprises an input transducer for converting acoustical information at an input thereof to electrical signals at an output thereof, a differential A/D converter having an input connected to the output of the input transducer and sampling the electrical signals to produce a differential signal sample at an output thereof, a digital multiplicative automatic gain control circuit for modifying the differential sampled signal according to the needs of the hearing aid user, wherein the digital multiplicative automatic gain control circuit may implement a linear function, a non-linear function with a homomorphic transformation, a non-linear function, or a table look-up. An integrator is connected to the output of the digital multiplicative automatic gain control circuit to sum successive processed digital signal samples, and a D/A converter having an input is connected to the output of the integrator. The output of the D/A converter is connected to the input of the output transducer. In an alternative embodiment of this aspect of the invention, the integrator and D/A converter are omitted, and a pulse coder having an input is connected to the output of the digital multiplicative automatic gain control circuit. The output of the pulse coder is connected to a driver amplifier employed to drive the output transducer.

According to a second aspect of the present invention, a hearing compensation system for the hearing impaired employs differential signal sampling. In the hearing compensation system, an input transducer is provided for converting acoustical information at an input to electrical signals at an output thereof. A differential A/D converter is provided having an input connected to the output of the input transducer and an output. A plurality of digital bandpass filters is provided, each digital bandpass filter having an input connected to the output of the differential A/D converter. A presently preferred embodiment of the invention employs 9–15 ½ octave bandpass filters and operates over a bandwidth of between about 200–10,000 Hz. The filters are designed as ½ octave multiples in bandwidth over the band from 500 Hz to 10,000 Hz, with a single band filter from 0–500 Hz. A plurality of digital AGC circuits is provided, each individual digital AGC circuit associated with a different one of the first digital bandpass filters and having an input connected to the output of its associated digital bandpass filter and an output added to the outputs of each of the other multiplicative automatic gain control circuits to form the output of the filter bank, wherein each of the digital multiplicative automatic gain control circuit may implement a linear function, a non-linear function with a homomorphic transformation, a non-linear function, or a table look-up. An integrator is connected to the output of the filter bank to sum successive processed digital signal samples. A D/A converter is provided having an input connected to the output of the integrator and an output connected to the input of the output transducer. In an alternative embodiment of this aspect of the invention, the integrator and D/A converter are omitted, and a pulse coder having an input is connected to the output of the filter bank. The output of the pulse coder is connected to a driver amplifier employed to drive the output transducer.

According to a third aspect of the present invention, a hearing compensation system for the hearing impaired employs differential signal sampling. In the hearing compensation system, an input transducer is provided for converting acoustical information at an input to electrical signals at an output thereof. A differential A/D converter is provided having an input connected to the output of the input transducer and an output. A first plurality of digital bandpass filters is provided, each digital bandpass filter having an input connected to the output of the differential A/D converter. A first plurality of digital AGC circuits is provided, each individual digital AGC circuit associated with a different one of the first digital bandpass filters and having an input connected to the output of its associated digital bandpass filter and an output connected to a first summing function, wherein each of the digital multiplicative automatic gain control circuits may implement a linear function, a non-linear function with a homomorphic transformation, a non-linear function, or a table look-up. A first integrator having an input is connected to the output of the first summing function and an output connected to a first D/A converter. The output of the first D/A converter is connected to the input of a first output transducer. In an alternative embodiment of this aspect of the invention, the first integrator and first D/A converter are omitted, and a pulse coder having an input is connected to the output of the first summing function. The output of the pulse coder is connected to a driver amplifier employed to drive the output transducer. A second plurality of digital bandpass filters is provided, each digital bandpass filter having an input connected to the output of the differential A/D converter. A second plurality of digital AGC circuits is provided, each individual AGC circuit associated with a different one of the second digital bandpass filters and having an input connected to the output of its associated digital bandpass filter and an output connected to a second summing function, wherein each of the digital multiplicative automatic gain control circuit may implement a linear function, a non-linear function with a homomorphic transformation, a non-linear function, or a table look-up. A second integrator having an input is connected to the output of the second summing function and an output connected to a second D/A converter. The output of the second D/A converter is connected to the input of a second output transducer. In an alternative embodiment of this aspect of the invention, the second integrator and second D/A converter are omitted, and a pulse coder having an input is connected to the output of the second summing function. The output of the pulse coder is connected to a driver amplifier employed to drive the output transducer. The first output transducer is configured so as to efficiently convert electrical energy to acoustic energy at lower frequencies and the second output transducer is configured so as to efficiently convert electrical energy to acoustic energy at higher frequencies. The bandpass frequency regions of the first and second plurality of digital bandpass filters are selected to be compatible with the frequency responses of the first and second output transducers, respectively.

BRIEF DESCRIPTION OF THE DRAWING FIGURES

DETAILED DESCRIPTION OF A PREFERRED EMBODIMENT

Those of ordinary skill in the art will realize that the following description of the present invention is illustrative only and not in any way limiting. Other embodiments of the invention will readily suggest themselves to such skilled persons.

In the present invention, the difference in the magnitude between successive digital signal samples is used to represent the sampled signal. To do so, a differential A/D converter, rather than a full magnitude A/D converter as found in prior art hearing aids, is used. In the embodiments of the present invention disclosed herein, the use of differential signal samples reduces the number of bits needed to represent the digital signal sample with the required precision. This reduces power consumption and circuit complexity.

Figure 1A:
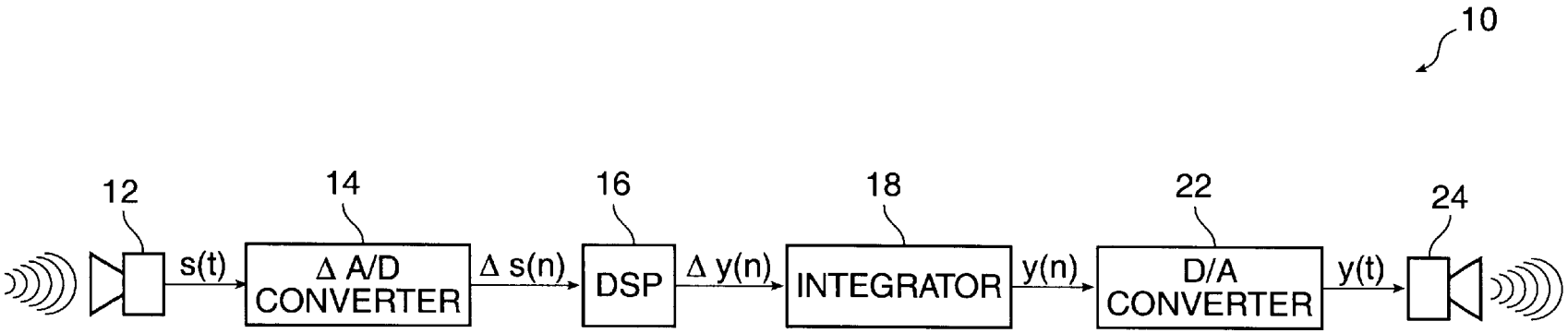
FIG. 1A is a block diagram of a hearing compensation system employing differential signal sampling according to the present invention.

Referring now to FIG. 1A, a block diagram of a hearing aid system 10 according to the present invention is shown. In FIG. 1A, an input transducer 12 converts acoustical energy into an analog electrical signal, s(t), representative of the acoustical energy. The analog electrical signal is converted to differential signal samples, Δs(n), by differential A/D converter 14. The differential A/D converter 14 may be any one of several known differential A/D converters including devices which use delta modulation, delta-sigma modulation, adaptive delta modulation and adaptive differential pulse-code modulation.

It should be appreciated that in prior art systems these A/D converters are followed by an integrating filter to provide a full amplitude representation of the signal. Differential AND conversion schemes are well known to those of ordinary skill in the art and will not disclosed in detail herein to avoid obscuring the invention. A presently preferred embodiment of differential A/D conversion using delta-sigma modulation may be found in U.S. application Ser. No. 08/731,963, filed Oct. 23, 1996, assigned to the same assignee as the present invention and expressly incorporated herein by reference.

The output, Δs(n), of the differential A/D converter 14 is fed into a DSP circuit 16 which modifies the signal according to parameters set to accommodate the needs of the hearing aid user. According to the present invention, the DSP circuit 16 may implement a linear function, a nonlinear function with a homomorphic transformation, a nonlinear function, or a table look-up. Implementation of the DSP circuit 16 for the nonlinear homomorphic case and the nonlinear case will be disclosed herein.

In contrast to prior art DSP-based hearing aid circuits, the DSP circuit 16 does not require a circuit implementation capable of handling the dynamic range needed to represent the full amplitude of signal, but rather only requires a circuit implementation capable of handling the amplitude of the differential digital signal, Δs(n). The resulting reduction in power consumption and circuit complexity in the DSP circuit 16 is substantial.

Figure 2A:
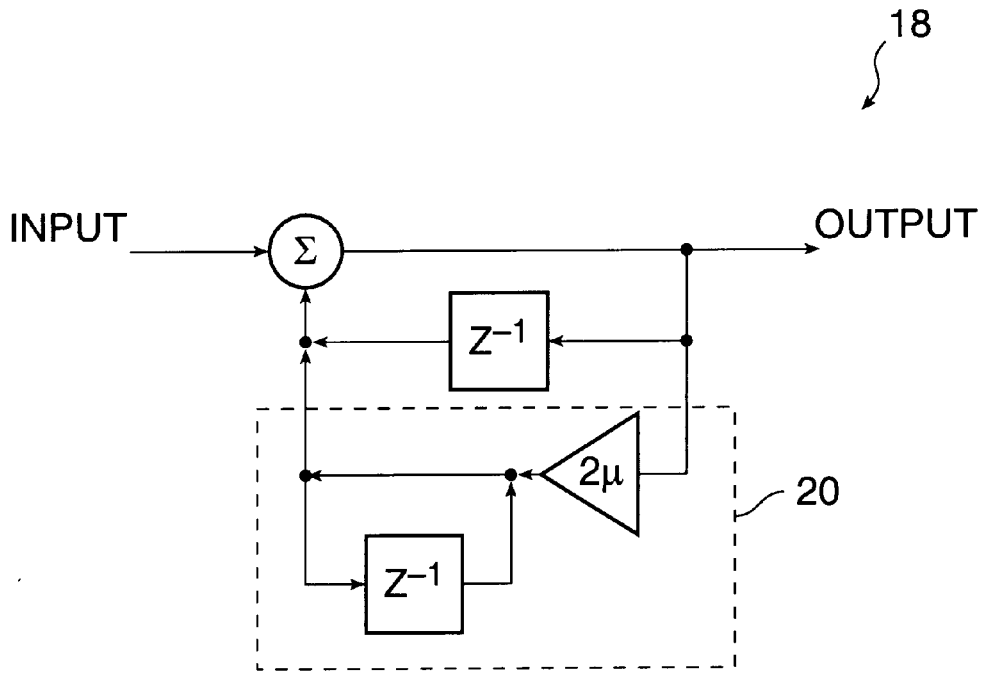
FIG. 2A is a state diagram of an integrator circuit with loss to eliminate bias suitable for use in the present invention.

The output of the DSP circuit 16 is a processed differential signal samples, Δy(n). Successive processed differential signal samples, Δy(n), are summed by integrator 18. The integrator 18 may be any of several lossy integrators known to those of ordinary skill the art. A signal flow diagram of integrator 18 is shown in FIG. 2. The signal sample delays are denoted in the signal flow diagram as $z^{-1}$. The operation of lossy integrators is well known in the art and will not be included herein to avoid overcomplicating the disclosure.

Included in the signal flow diagram of the integrator 18 is a high pass filter 20 with a corner frequency much less than 1 Hz. The corner frequency of the high pass filter is 2 $\mu$f, where f is the sample frequency. Accordingly, a nominal value of $\mu=2^{-15}$ is adequate for the integrator 18 disclosed herein. The inclusion of the high pass filter 20 in the integrator 18 essentially eliminates DC offset bias. An illustrative example of a high pass filter design is disclosed in B. Widrow, et al. "Adaptive Noise Canceling: Principles and Applications," Proceedings of the IEEE, Vol. 63, No. 12, Dec. 1975, pp. 1692–1716.

Turning again to FIG. 1A, the output of the integrator 18 is fed through a D/A converter 22 to an output transducer 24, which converts the electrical signals into acoustical energy. The D/A converter 22 may be implemented using one of many D/A converters known to those of ordinary skill in the art. As will also be appreciated by those of ordinary skill in the art, output transducer 24 may be one of a variety of known available hearing-aid earphone transducers, such as a model ED 1932, available from Knowles Electronics of Ithaca, Ill., in conjunction with a calibrating amplifier to ensure the transduction of a specified electrical signal level into the correspondingly specified acoustical signal level. Alternately, transducer 24 may be another earphone-like device or an audio power amplifier and speaker system.

Figure 1B:
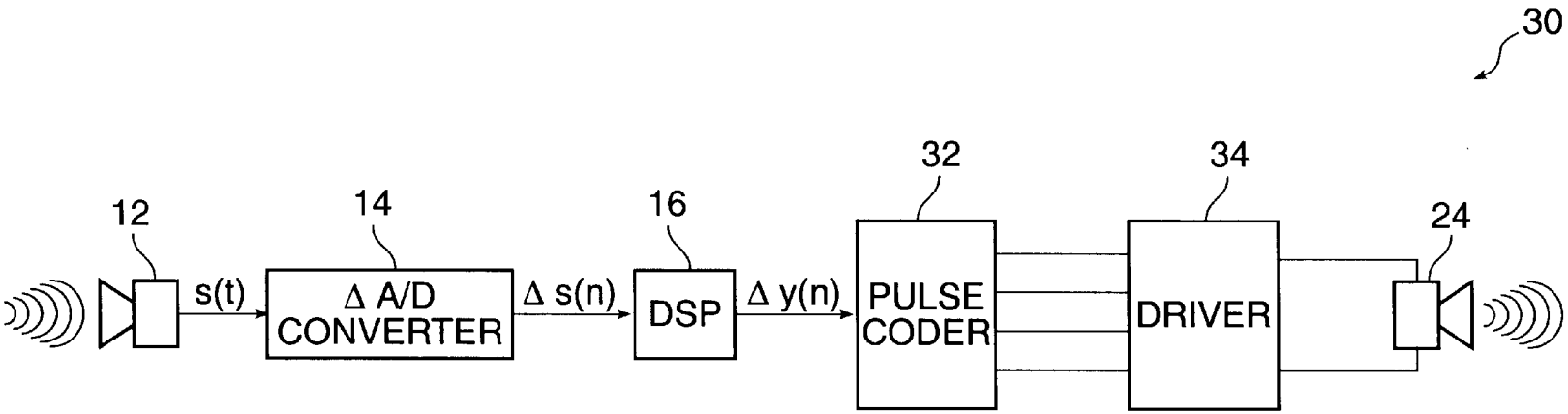
FIG. 1B is a block diagram of a hearing compensation system employing differential signal sampling and output pulse width modulation according to the present invention.

Turning to FIG. 1B, an alternative embodiment of the hearing aid system 10 of FIG. 1A is shown. In the hearing aid system 30 of FIG. 1B, the integrator 18 and D/A converter 22 of hearing aid system 10 are omitted, and the digital values of the processed differential signal outputs, Δy(n), are converted by a pulse coder 32 into digital pulses having a duration proportional to the value of the processed differential signal outputs, Ay(n). The output pulses of the pulse coder 32 control a driver amplifier 34 employed to drive the output transducer 24. By eliminating the integrator 18 and D/A converter 22, fewer bits are needed to represent the differential signals and coarser time slots between the differential signals may be employed.

Using the processed differential signal outputs, Δy(n), to generate pulse widths to drive the output transducer 24 directly, takes advantage of the inherently integrating nature of output transducer 24. The use of digital pulse width to drive the output transducer 24 follows from the fact that in the present invention the differential signal representations of the acoustical input are the time derivative of the acoustical input amplitude, rather than the acoustical input amplitude itself. In the prior art it is well accepted that the acoustical amplitude from a loudspeaker is proportional to the voltage driving the loudspeaker speaker, independent of frequency, as long as the frequency is below the resonance of the loudspeaker. In contrast, in the present invention, it is recognized that in a sealed ear canal below the transducer resonance, the time derivative of the acoustical amplitude, rather than the acoustical amplitude, is proportional to the driving voltage of the output transducer 24.

In an ordinary loudspeaker, a lightweight cone is driven by a voice coil in a magnetic field. The cone acts as piston, and sets the velocity of the air which it contacts. For an ordinary acoustical wave in free space, the sound velocity field is proportional to the acoustical pressure (amplitude), independent of frequency. The flux $\phi$ linking the voice coil is proportional to the position x of the cone, so that the time derivative of the flux $\phi$ and therefore the voltage across the coil are proportional to the time derivative of the position x or the velocity. Accordingly, the acoustical amplitude from a loudspeaker is proportional to the amplitude of the voltage driving the speaker.

However, for a hearing aid completely in the ear canal, where the remaining space is deliberately made small and is not vented to the outside, the relationship between the driving voltage of the output transducer and the acoustical amplitude is much different. In this configuration, at frequencies below the resonance of the transducer, the trapped air works as a spring against the moving transducer member. As a consequence, the acoustical pressure (amplitude) is proportional to the position of the moving member of the transducer, and it is therefore the time derivative of the acoustical pressure, rather than the acoustical pressure itself, which is proportional to the velocity.

The output transducer 24 will integrate the pulse widths, representing the time derivative of the acoustical pressure (the processed differential signal samples) into a smooth function in the form of the ear canal pressure. To satisfy the Nyquist sampling theorem, the repetition rate of the pulses from pulse coder 32 must be higher than twice the highest frequency passed by the DSP 16. The repetition rate can conveniently be the same as the sample rate of the DSP 16.

Figure 2B:
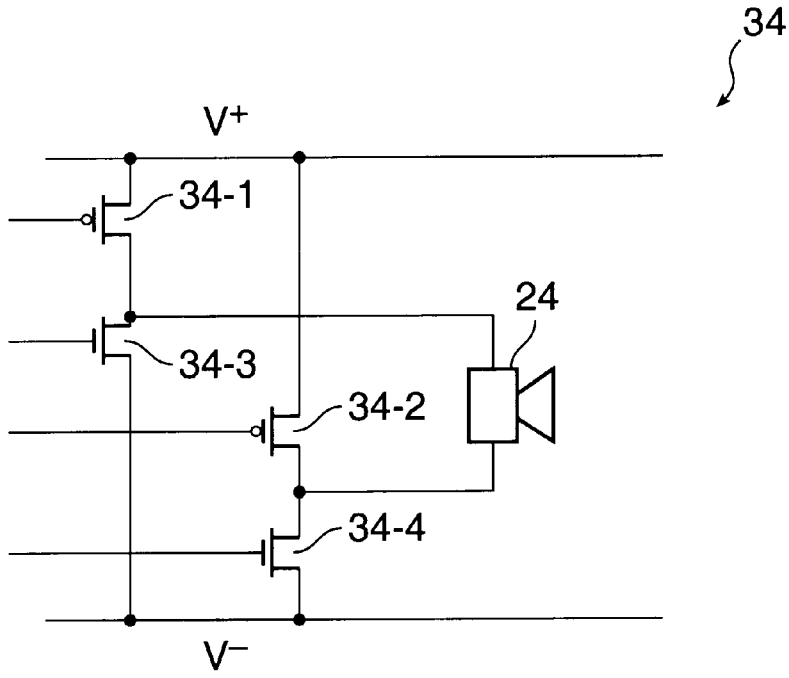
FIG. 2B is a schematic diagram of a driver amplifier suitable for use in the present invention.

A driver amplifier 34 suitable for use in the present invention is shown in FIG. 2B. The driver amplifier 34 in FIG. 2B is an efficient driver amplifier well known in the art. Those of ordinary skill in the art will recognize that other implementations of driver amplifier 34 may be made. In driver amplifier 34, the sources of first and second P-channel MOS transistors 34-1 and 34-2 are connected to a positive voltage supply rail, and the sources of first and second N-channel MOS transistors 34-3 and 34-4 are connected to a negative voltage supply rail. A common node formed by the connection of the drain of first P-channel MOS transistor 34-1 to the drain of first N-channel MOS transistor 34-3 is connected to a first input of output transducer 24, and a common node formed by the connection of the drain of second P-channel MOS transistor 34-2 to the drain of second N-channel MOS transistor 34-4 is connected to a second input of output transducer 24.

By driving a train of signal pulses to either of the power supply rails of driver amplifier 34 for a given time, the pulse width output of driver amplifier 34 is the analog variable driving output transducer 24, rather than a voltage. Driver amplifier 34 is a "Class D" amplifier. Care must be taken when driving the output transducer 24 with pulse widths due to its inductive nature. When the processed differential signal output, $\Delta y(n)$, is positive, the gates of first P-channel MOS transistor 34-1 and first N-channel MOS transistor 34-3 are driven to the negative power supply rail, and the gates of second P-channel MOS transistor 34-2 and second N-channel MOS transistor 34-4 are driven to the positive power supply rail by a signal pulse from pulse coder 32 for a pulse period proportional to the magnitude of the processed differential signal output, $\Delta y(n)$. When the pulse period is finished, the voltage applied to the output transducer 24 is set to zero by driving the gates of both first and second N-channel MOS transistors 34-3 and 34-4 and first and second P-channel MOS transistors 34-1 and 34-2 to the positive power supply rail.

For a negative processed differential signal output, $\Delta y(n)$, the gates of first P-channel MOS transistor 34-1 and first N-channel MOS transistor 34-3 are driven to the positive power supply rail, and the gates of second P-channel MOS transistor 34-2 and second N-channel MOS transistor 34-4 are driven to the negative power supply rail by a train of signal pulse from pulse coder 32 for a pulse period proportional to the magnitude of the processed differential signal output, $\Delta y(n)$. By driving the output transducer 24 for both positive and negative processed differential signal outputs, $\Delta y(n)$, in this manner, the output transducer 24 is always driven with a voltage source. As a result, no high-voltage inductive spikes are generated. Further, both sign and magnitude information for the processed differential signal outputs are used to drive the output transducer 24.

Figure 3:
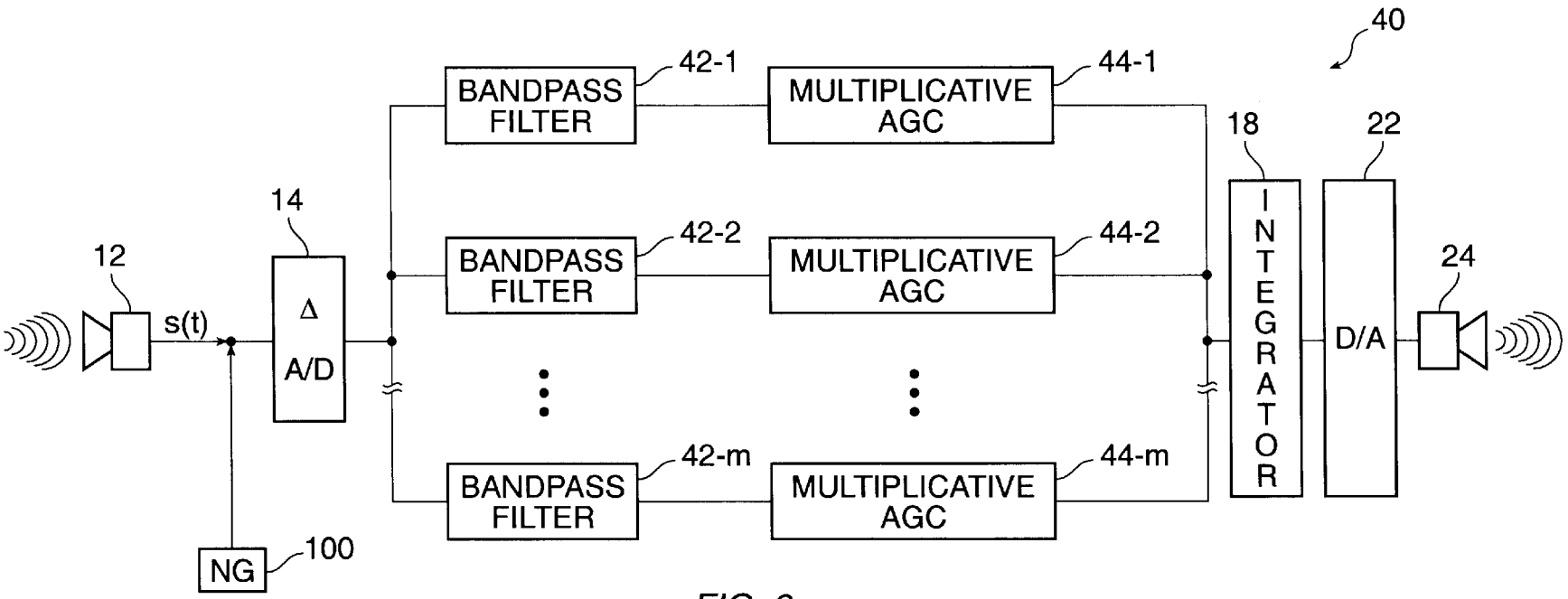
FIG. 3 is a block diagram of a multiband hearing compensation system employing differential signal sampling according to the present invention.

Turning now to FIG. 3, a block diagram of a multiband hearing aid system 40 according to the present invention using differential signal samples is shown. The block diagram in FIG. 3 is in many respects similar to the block diagram in FIG. 1, and accordingly, where like blocks are implemented, the same reference numerals will be used. In FIG. 3, an input transducer 12 converts acoustical energy into an analog electrical signal, s(t), representative of the acoustical energy. The analog electrical signal is converted to a differential signal sample, $\Delta s(n)$, by differential A/D converter 14.

The differential signal sample, $\Delta s(n)$, is fed into a plurality of audio bandpass filters shown at reference numerals 42-1, 42-2 and 42-m to filter the sampled signal into m channels. According to the preferred embodiment of the invention, m will be an integer from 9 to 15, preferably 9 channels, although persons of ordinary skill in the art will understand that the present invention will function if m is a different integer. Unlike bandpass filters in a multiband system according to the prior art, the bandpass filters 42-1 to 42-m do not require circuit implementations capable of handling the bandwidth needed to represent the full amplitude of signal, but rather only require circuit implementations capable of handling the bandwidth of the differential digital signal. The resulting reduction in power consumption and circuit complexity in the bandpass filters 42-1 to 42-m circuits is substantial.

Audio bandpass filters 42-1 to 42-m preferably have a bandpass resolution of ½ octave or less, but in no case less than about 125 Hz, and have their center frequencies logarithmically spaced over a total audio spectrum of from about 200 Hz to about 10,000 Hz. It has been discovered that the appropriate approach to high fidelity hearing compensation is to separate the input acoustic stimulus into frequency bands with a resolution at least equal to the critical bandwidth, which for a large range of the sound frequency spectrum is less than ½ octave. The audio bandpass filters may have bandwidths broader than ½ octave, i.e., up to an octave or so, but with degrading performance. The design of ½ octave bandpass filters is well within the level of skill of the ordinary worker in the art. Therefore the details of the circuit design of any particular bandpass filter will be simply a matter of design choice for such skilled persons in the art.

Bandpass filters 42-1 through 42-m suitable for use in the present invention are realized as fifth-order Chebyshev band-split filters which provide smooth frequency response in the passbands and about 65 dB rejection in the stopband. Those of ordinary skill in the art will recognize that several bandpass filter designs including, but not limited to, other Chebyshev, Elliptic, Butterworth, or Bessel filters, may be employed. Further, filter banks designed using wavelets, as disclosed, for example, in R. A. Gopinath, Wavelets and Filter Banks-New Results and Applications, PhD Dissertation, Rice University, Houston, Tex., May 1993, may offer some advantage. Any of these bandpass filter designs may be employed without deviating from the concepts of the invention disclosed herein. Those of ordinary skill in the art will recognize that although the bandpass filters 42-1 to 42-m are shown discreetly in FIG. 3, the bandpass filters 42-1 through 42-m may be realized as a single circuit in a microprocessor which filters the differential signal sample in an iterative manner.

Each individual bandpass filter 42-1 to 42-m is cascaded with a digital multiplicative automatic gain control (AGC) circuit 44-1 to 44-m, respectively. The multiplicative AGC circuits 44-1 to 44-m perform DSP operations on the outputs from the bandpass filters 42-1 to 42-m. The DSP operations of the multiplicative AGC circuits 44-1 to 44-m may be linear, non-linear homomorphic, or non-linear functions or may be replaced with a table lookup. Also, like the bandpass filters 42-1 to 42-m, the digital multiplicative AGC circuits 44-1 to 44-m do not require circuit implementations capable of handling the bandwidth needed to represent the full amplitude of the sampled signal, but rather only require circuit implementations capable of handling the bandwidth of the differential digital signal. The resulting reduction in power consumption and circuit complexity in the digital multiplicative AGC circuits 44-1 to 44-m is substantial.

In each channel, the processed differential signal sample, $\Delta y_m(n)$, output from the non-linear multiplicative AGC circuits are summed together to form the processed differential signal sample $\Delta y(n)$. Successive processed differential signal samples, $\Delta y(n)$, are summed by integrator 18. The output of the integrator 18 is fed through a D/A converter 22 to an output transducer 24, which converts the electrical signals into acoustical energy. In accordance with previous description of FIG. 1B herein, it should be appreciated by those of ordinary skill in the art that the integrator 18 and D/A converter 22 may be omitted, and the output transducer 24 driven by pulses from an amplifier driver using as input a pulse train of digital pulses proportional to the value of the processed differential signal samples, $\Delta y(n)$.

Those of ordinary skill in the art will recognize that the principles of the present invention may be applied to audio applications other than hearing compensation for the hearing impaired. Non-exhaustive examples of other applications of the present invention include music playback for environments with high noise levels, such as automotive environments, voice systems in factory environments, and graphic sound equalizers such as those used in stereophonic sound systems.

Figure 4A:
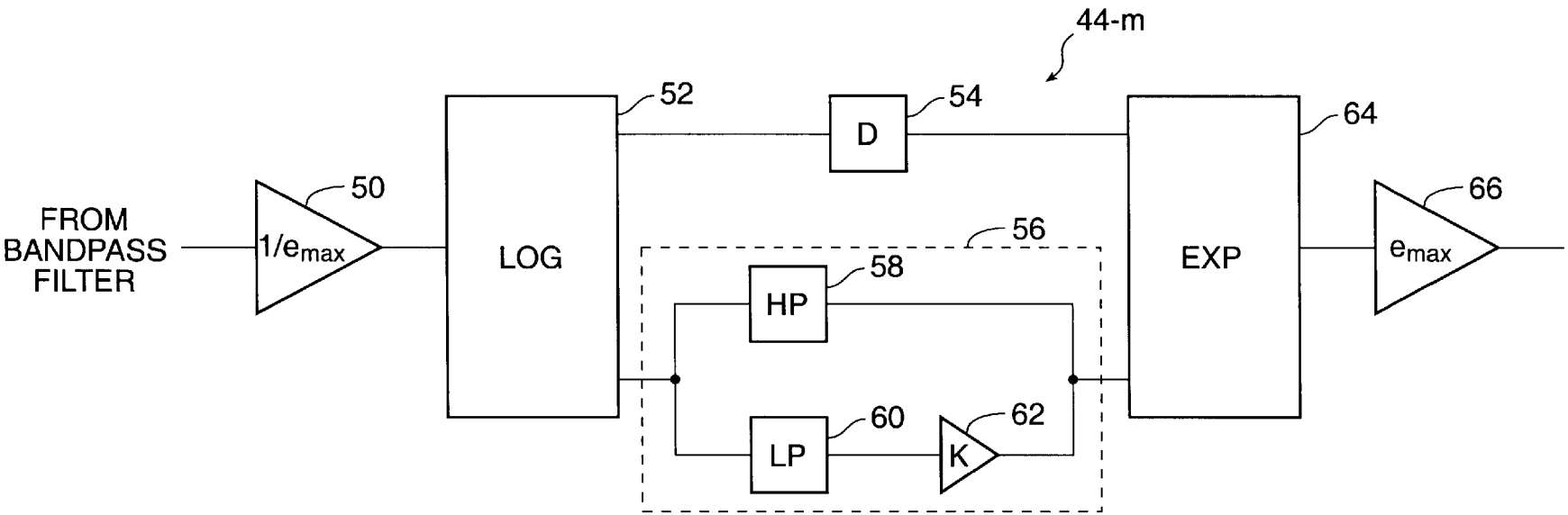
FIG. 4A is a more detailed block diagram of a typical multiplicative AGC circuit according to a presently preferred embodiment of the invention.

Several embodiments of non-linear DSP multiplicative AGC circuits with a homomorphic transformation and suitable for use in the present invention are described in FIGS. 4*a,* 4*b*, 6*a*, 6*b,* 7*a,* and 7*b.* A detailed description of multiplicative AGC circuits may be found in U.S. Pat. No. 5,500,902, which is incorporated herein by reference. Further below, the operation of a non-linear multiplicative AGC circuit, including a function defined by a table lookup, will be described.

In FIGS. 4*a,* 4*b,* 6*a,* 6*b,* 7*a,* and 7*b,* the circuit elements of the hearing compensation apparatus of the present invention are implemented as a digital circuit, preferably a microprocessor or other computing engine performing DSP functions to emulate the analog circuit functions of the various components such as filters, amplifiers, etc. As described above, in the present invention, the incoming audio signal will be time sampled and digitized using a differential A/D conversion technique. The differential samples from the A/D converter represent the difference in the amplitude between successive samples of the signal. The circuits used to perform the DSP only need to have sufficient bandwidth to handle the number of bits required to represent the difference in the amplitude between successive signal samples. The use of differential sample A/D converter greatly lowers the power consumption and reduces the complexity of the circuits involved.

Referring now to FIG. 4*a*, a more detailed conceptual block diagram of a typical multiplicative AGC circuit 44-m according to a presently preferred embodiment of the invention is shown. As previously noted, multiplicative AGC circuits are known in the art. An illustrative multiplicative AGC circuit which will function in the present invention is disclosed in the article T. Stockham, Jr., The Application of Generalized Linearity to Automatic Gain Control, IEEE Transactions on Audio and Electroacoustics, AU-16(2): pp 267–270, June 1968. A similar example of such a multiplicative AGC circuit may be found in U.S. Pat. No. 3,518,578 to Oppenheim et al.

Conceptually, the multiplicative AGC circuit 44-m which may be used in the present invention accepts an input signal at amplifier 50 from the output of one of the audio bandpass filters 42-m. Amplifier 50 is set to have a gain of $1/e_{max}$, where $e_{max}$ is the maximum value of the audio envelope for which AGC gain is applied (i.e., for input levels above $e_{max}$, AGC attenuation results). Within each band segment in the apparatus of the present invention, the quantity $e_{max}$ is the maximum acoustic intensity for which gain is to be applied. This gain level for $e_{max}$ (determined by audiological examination of a patient) often corresponds to the upper comfort level of sound. In the DSP implementation, amplifier 50 may be a multiplier function having the input signal as one input term and the constant $1/e_{max}$ as the other input term.

The output of amplifier 50 is processed in the "LOG" block 52 to derive the logarithm of the signal. The LOG block 52 derives a complex logarithm of the input signal, with one output representing the sign of the input signal and the other output representing the logarithm of the absolute value of the input. In the DSP implementation, LOG block 52 may be implemented as a software subroutine running on a microprocessor or similar computing engine as is well known in the art, or from other equivalent means such as a look-up table. Examples of such implementations are found in Knuth, Donald E., The Art of Computer Programming, Vol. 1, Fundamental Algorithms, Addison-Wesley Publishing 1968, pp. 21–26 and Abramowitz, M. and Stegun, I. A., Handbook of Mathematical Functions, US Department of Commerce, National Bureau of Standards, Appl. Math Series 55, 1968. Those of ordinary skill in the art will recognize that by setting the gain of the amplifier 50 to $1/e_{max}$, the output of amplifier 50 (when the input is less than $e_{max}$,) will never be greater than one and the logarithm term out of LOG block 52 will always be 0 or less.

Figure 5:
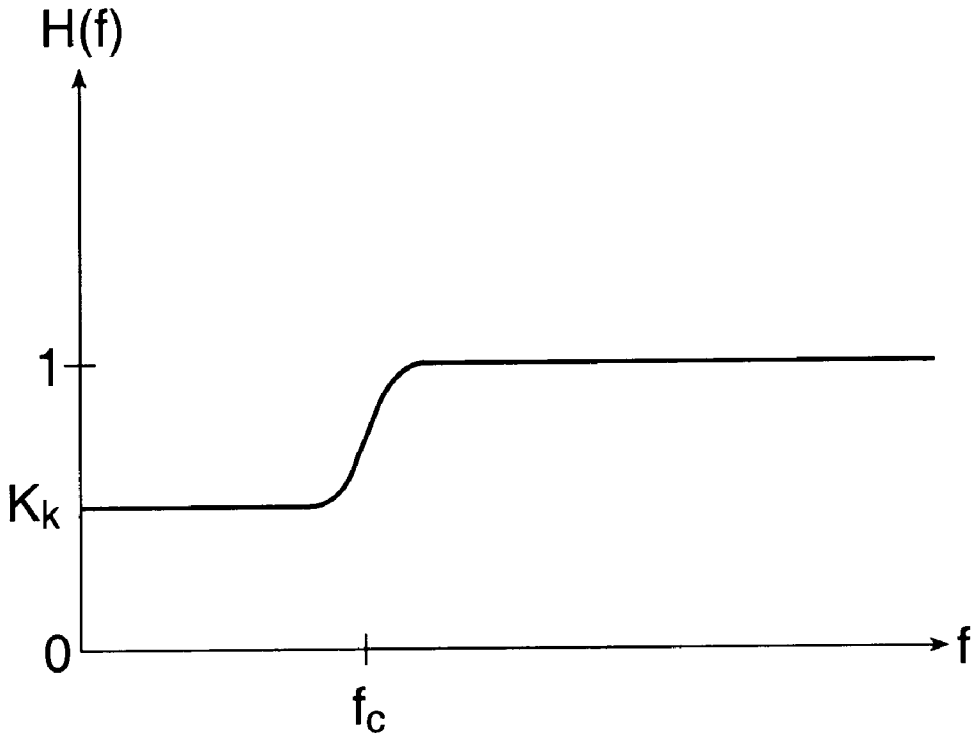
FIG. 5 is a plot of the response characteristics of the filter employed in the multiplicative AGC circuit of FIG. 4A.

The first output of LOG block 52 containing the sign information of its input signal is presented to a Delay block 54, and a second output of LOG block 52 representing the logarithm of the absolute value of the input signal is presented to a filter 56 having a characteristic preferably like that shown in FIG. 5. Conceptually, filter 56 may comprise both high-pass filter 58 and low-pass filter 60 followed by amplifier 62 having a gain equal to K. As will be appreciated by those of ordinary skill in the art, high-pass filter 58 may be synthesized by subtracting the output of the low-pass filter 60 from its input.

Both high-pass filter 58 and low-pass filter 60 have a cutoff frequency that is determined by the specific application. In a hearing compensation system application, a nominal cutoff frequency is about 16 Hz, however, other cutoff frequencies may be chosen for low-pass filter 60 up to about ⅛ of the critical bandwidth associated with the frequency band being processed without deviating from the concepts of this invention. Those of ordinary skill in the art will recognize that filters having response curves other than that shown in FIG. 5 may be used in the present invention. For example, other non-voice applications of the present invention may require a cutoff frequency higher or lower than 16 Hz. As a further example, implementation of a cutoff frequency for low-pass filter 60 equal to ⅛ of the critical bandwidth associated with the frequency channel being processed (i.e., 42-1 through 42-m in FIG. 3) provides for more rapid adaptation to transient acoustic inputs such as a gunshot, hammer blow or automobile backfire.

The sign output of the LOG block 52 which feeds delay 54 has a value of either 1 or 0 and is used to keep track of the sign of the input signal to LOG block 22. The delay 54 is such that the sign of the input signal is fed to the EXP block 64 at the same time as the data representing the absolute value of the magnitude of the input signal, resulting in the proper sign at the output. In the present invention, the delay is made equal to the delay of the high-pass filter 58.

Those of ordinary skill in the art will recognize that many designs exist for amplifiers and for DSP filter implementations, and that the design for the filters described herein may be elected from among these available designs. In the digital implementation of the present invention, amplifier 62 may be a multiplier function having the input signal as one input term and the constant K as the other input term. DSP filter techniques are well understood by those of ordinary skill in the art.

The outputs of high-pass filter 58 and amplifier 62 are combined and presented to the input of EXP block 64 along with the unmodified output of LOG block 52. EXP block 64 processes the signal to provide an exponential function. In the DSP implementation of the present invention, EXP block 64 may be implemented as a software subroutine as is well known in the art, or from other equivalent means such as a look-up table. Examples of known implementations of this function are found in the Knuth and Abramowitz et al. references, and U.S. Pat. No. 3,518,578, previously cited.

It is well known that acoustical energy may be conceptualized as the product of two components. The first is the always positive slowly varying envelope and may be written as e(t), and the second is the rapidly varying carrier which may be written as v(t). The total sound may be expressed as:

$$s(t)=e(t)\cdot v(t)$$

Digital samples of sound are denoted s(n), wherein n is the sample index, and the total sound is expressed as:

$$s(n)=e(n)\cdot v(n)$$

Since an audio waveform is not always positive (i.e., v(n) is negative about half of the time), its logarithm at the output of LOG block 52 will have a real part and an imaginary part. If LOG block 52 is configured to process the absolute value of s(n), its output will be the sum of log $(e(n)/e_{max})$ and log $|v(n)|$. Since log $|v(n)|$ contains high frequencies, it will pass through high-pass filter 58 essentially unaffected. The component log $(e(n)/e_{max})$ contains low frequency components and will be passed by low-pass filter 60 and emerge from amplifier 62 as K log $(e(n)/e_{max})$. The output of EXP block 64 will therefore be:

$$(e(n)/e_{max})^{k}\cdot v(n)$$

When K<1, it may be seen that the processing in the multiplicative AGC circuit 44-m of FIG. 4*a* performs a compression function. Persons of ordinary skill in the art will recognize that embodiments of the present invention using these values of K are useful for applications other than hearing compensation.

According to a presently preferred embodiment of the invention employed as a hearing compensation system, K may be about between zero and 1. The number K will be different for each frequency band for each hearing impaired person and may be defined as follows:

$$K=[1-(HL/(UCL-NHT)]$$

where HL is the hearing loss at threshold (in dB), UCL is the upper comfort level (in dB), and NHT is the normal hearing threshold (in dB). Thus, the apparatus of the present invention may be customized to suit the individual hearing impairment of the wearer as determined by examination. The multiplicative AGC circuit 44-m in the present invention provides no gain for signal intensities at the upper sound comfort level and a gain equivalent to the hearing loss for signal intensities associated with the normal hearing threshold.

The output of EXP block 64 is fed into amplifier 66 with a gain of $e_{max}$ in order to rescale the signal to properly correspond to the input levels which were previously scaled by $1/e_{max}$ in amplifier 50. Amplifiers 50 and 66 are similarly configured except that their gains differ as just explained.

Figure 4B:
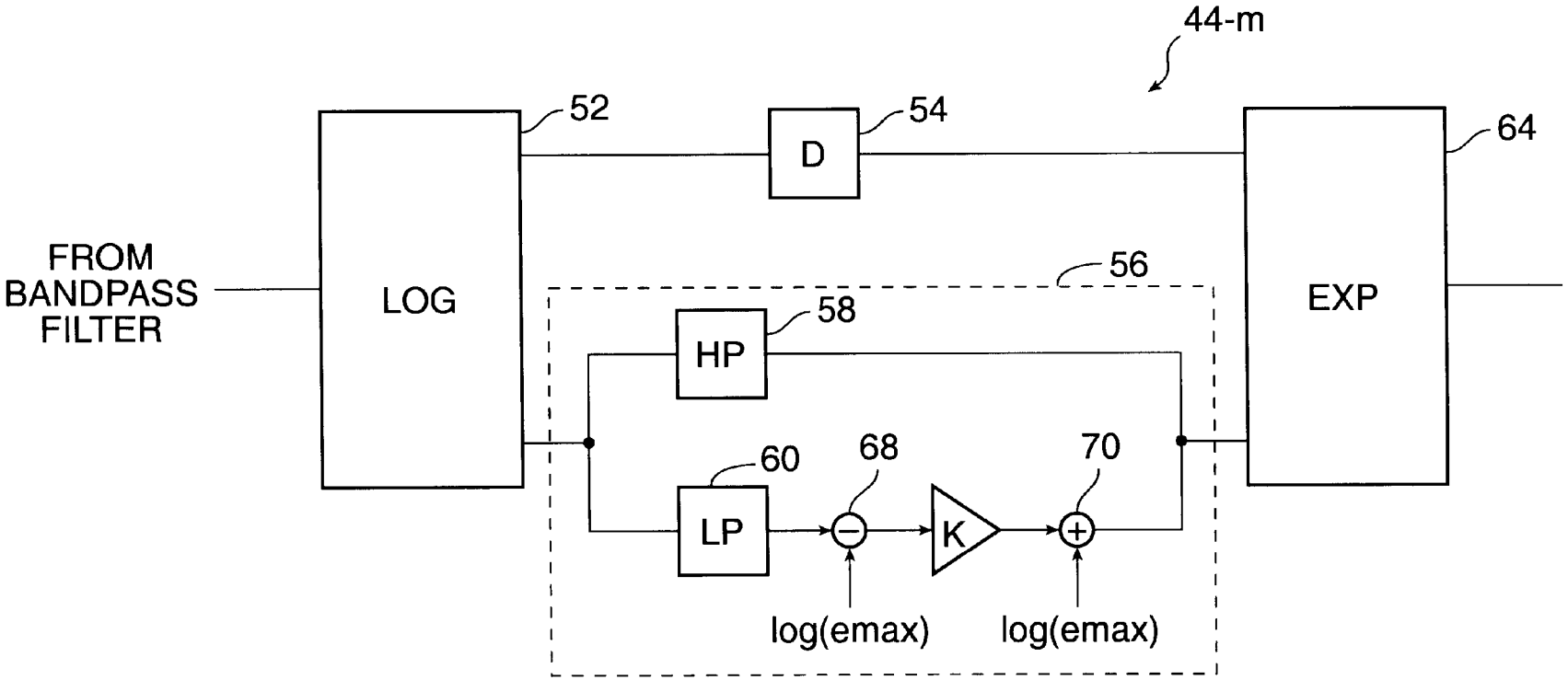
FIG. 4B is a more detailed block diagram of a typical multiplicative AGC circuit according to a equivalent embodiment of the invention.

FIG. 4*b* is a block diagram of a circuit which is a variation of the circuit shown in FIG. 4*a*. Persons of ordinary skill in the art will recognize that amplifier 50 may be eliminated and its gain $(1/e_{max})$ may be equivalently implemented by subtracting the value log $e_{max}$ from the output of low pass filter 60 in subtractor circuit 68. Similarly, in FIG. 4*b*, amplifier 66 has been eliminated and its gain $(e_{max})$ has been equivalently implemented by adding the value log $e_{max}$ to the output from amplifier 62 in adder circuit 70 without departing from the concept of the present invention. In the digital embodiment of FIG. 4*b*, the subtraction or addition my be achieved by simply subtracting/adding the amount log $e_{max}$.

When K>1, the AGC circuit 44-m becomes an expander. Useful applications of such a circuit include noise reduction by expanding a desired signal.

Those of ordinary skill in the art will recognize that when K is negative (in a typical useful range of about zero to −1), soft sounds will become loud and loud sounds will become soft. Useful applications of the present invention in this mode include systems for improving the intelligibility of a low volume audio signal on the same signal line with a louder signal.

Despite the fact that multiplicative AGC has been available in the literature since 1968, and has been mentioned as a candidate for hearing aid circuits, it has been largely ignored by the hearing aid literature. Researchers have agreed, however, that some type of frequency dependent gain is necessary. Yet even this agreement is clouded by perceptions that a bank of filters with AGC will destroy speech intelligibility if more than a few bands are used, see, e.g., R. Plomp, The Negative Effect of Amplitude Compression in Hearing Aids in the Light of the Modulation-Transfer Function, Journal of the Acoustical Society of America, 83, 6, June 1983, pp. 2322–2327. The understanding that a separately configured multiplicative AGC for a plurality of sub-bands across the audio spectrum may be used according to the present invention is a substantial advance in the art.

Figure 6A:
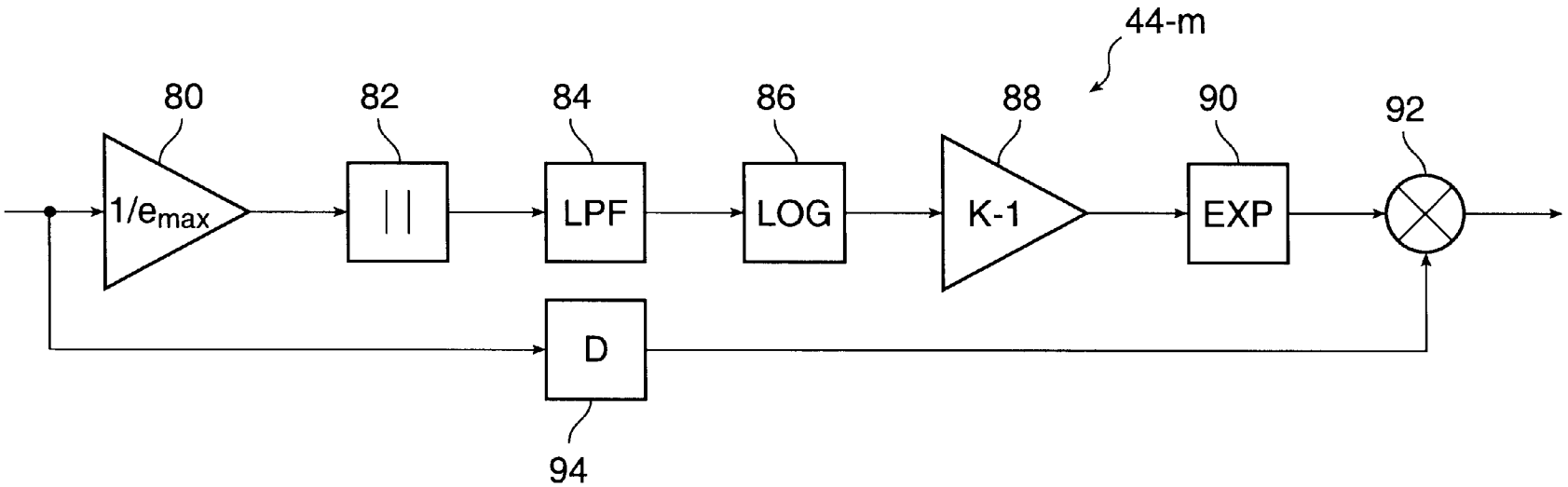
FIG. 6A is a block diagram of an alternate embodiment of the multiplicative AGC circuit of the present invention wherein the log function follows the low-pass filter function.

Referring now to FIG. 6*a,* a block diagram is presented of an alternate embodiment of the multiplicative AGC circuit 44-m of the present invention wherein the log function follows the low-pass filter function. Those of ordinary skill in the art will appreciate that the individual blocks of the circuit of FIG. 6*a* which have the same functions as corresponding blocks of the circuit of FIG. 4*a* may be configured from the same elements as the corresponding ones of the blocks of FIG. 4*a.*

Like the multiplicative AGC circuit 44-m of FIG. 4*a,* the multiplicative AGC circuit 44-m of FIG. 6*a* accepts an input signal from the output of one of the audio bandpass filters 42-m. Amplifier 80 is set to have a gain of $1/e_{max}$, where $e_{max}$ is the maximum allowable value of the audio envelope for which AGC gain is to be applied.

The output of amplifier 80 is passed to absolute value circuit 82. In a digital circuit, the implementation of the absolute value circuit 82 is accomplished by taking the magnitude of the digital number.

The output of absolute value circuit 82 is passed to low-pass filter 84. Low-pass filter 84 may be configured in the same manner as disclosed with reference to FIG. 4*a*. The absolute value circuit 82 may function as a half-wave rectifier, a full-wave rectifier, or a circuit whose output is the RMS value of the input with an appropriate scaling adjustment. Those of ordinary skill in the art will recognize that the combination of the absolute value circuit 82 and the low-pass filter 84 provide an estimate of the envelope e(n) and hence is known as an envelope detector. Several implementations of envelope detectors are well known in the art and may be used without departing from the teachings of the invention.

In a presently preferred embodiment, the output of low-pass filter 84 is processed in the "LOG" block 86 to derive the logarithm of the signal. The input to the LOG block 86 is always positive due to the action of absolute value block 84, hence no phase or sign term from the LOG block 86 is used. Again, because the gain of the amplifier 80 is set to $1/e_{max}$, the output of amplifier 80 for inputs less than $e_{max}$, will never be greater than one and the logarithm term out of LOG block 86 will always be 0 or less.

The logarithmic output signal of LOG block 86 is presented to an amplifier 88 having a gain equal to K−1. Other than its gain being different from amplifier 50 of FIG. 4*a,* amplifiers 50 and 88 may be similarly configured. The output of amplifier 88 is presented to the input of EXP block 90 which processes the signal to provide an exponential (anti-log) function.

The output of EXP block 90 is combined with the input to amplifier 80 in multiplier 92. There are a number of known ways to implement multiplier 92. In the digital implementation, this is simply a multiplication. As in the embodiment depicted in FIG. 4*a,* the input to amplifier 80 of the embodiment of FIG. 6*a* is delayed prior to presentation to the input of multiplier 92. Delay block 94 has a delay equal to the group delay of low pass filter 84.

Figure 6B:
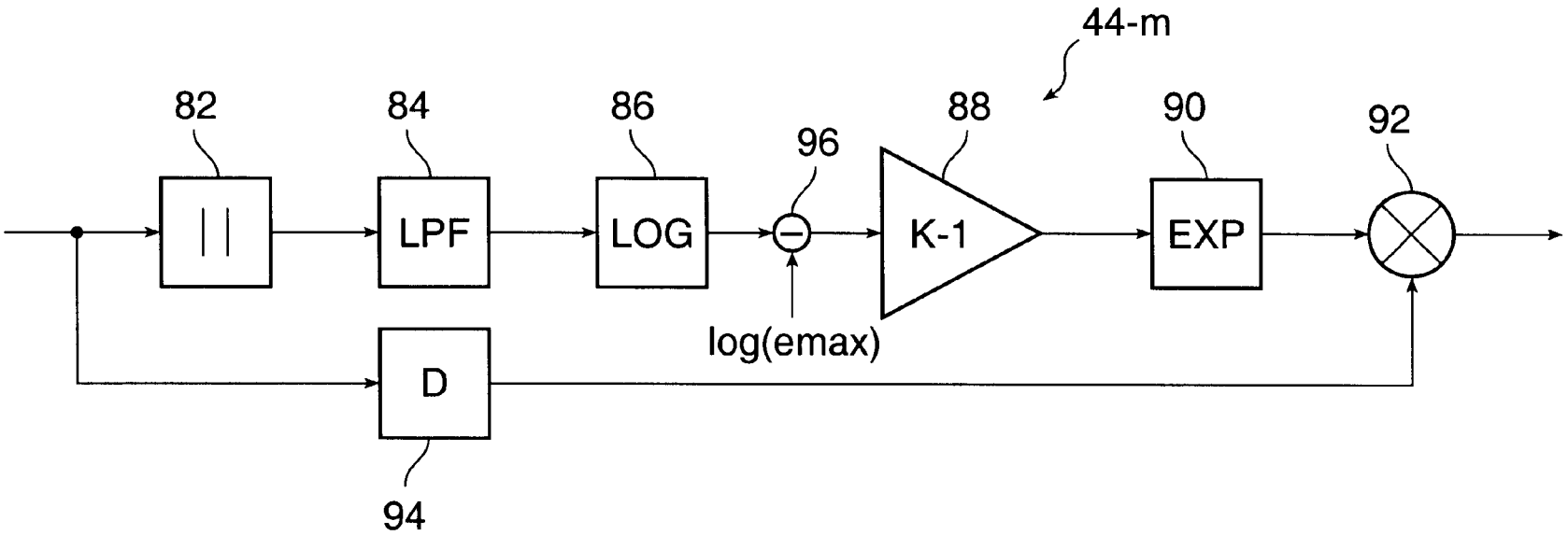
FIG. 6B is a block diagram of an alternate embodiment of the multiplicative AGC circuit of FIG. 6A.

FIG. 6*b* is a block diagram of a circuit which is a variation of the circuit shown in FIG. 6*a*. Those of ordinary skill in the art will recognize that amplifier 80 may be eliminated and its gain, $1/e_{max}$, may be equivalently implemented by subtracting the value log $e_{max}$ from the output of log block 86 in subtractor circuit 96, as shown in FIG. 6*b,* without deviating from the concepts herein.

While the two multiplicative AGC circuits 44-m shown in FIGS. 4*a* and 4*b,* and FIGS. 6*a* and 6*b* are implemented differently, it has been determined that the output resulting from either the log-lowpass implementation of FIGS. 4*a* and 4*b* and the output resulting from the lowpass-log implementation of FIGS. 6*a* and 6*b* are substantially equivalent, and the output of one cannot be said to be more desirable than the other. In fact, it is thought that the outputs are sufficiently similar to consider the output of either a good representation for both. Listening results of tests performed for speech data to determine if the equivalency of the log-lowpass and the lowpass-log was appropriate for the human auditory multiplicative AGC configurations indicate the intelligibility and fidelity in both configurations were nearly indistinguishable.

Although intelligibility and fidelity are equivalent in both configurations, analysis of the output levels during calibration of the system for specific sinusoidal tones revealed that the lowpass-log maintained calibration while the log-lowpass system deviated slightly from calibration. While either configuration would appear to give equivalent listening results, calibration issues favor the low-pass log implementation of FIG. 6*a* and 6*b*.

The multi-band multiplicative AGC adaptive compression approach of the present invention has no explicit feedback or feedforward. With the addition of a modified soft-limiter to the multiplicative AGC circuit 44-m, stable transient response and a low noise floor is ensured. Such an embodiment of a multiplicative AGC circuit for use in the present invention is shown in FIG. 7*a*.

Figure 7A:
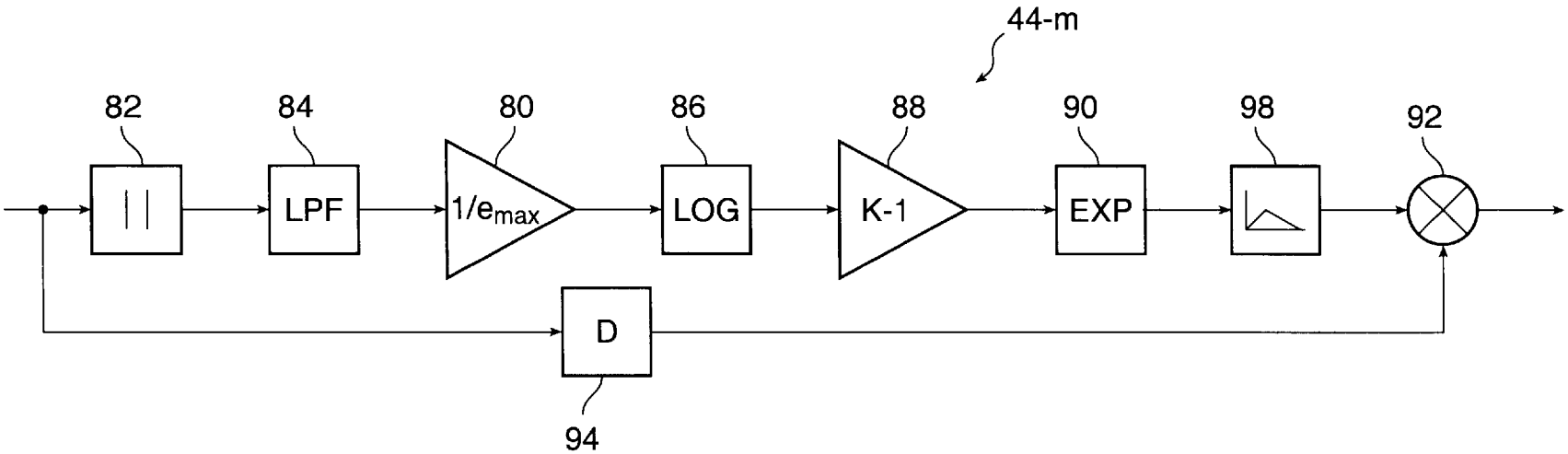
FIG. 7A is a block diagram of an alternate embodiment of the multiplicative AGC circuit of the present invention further including a modified soft-limiter.

The embodiment of FIG. 7*a* is similar to the embodiment shown in FIG. 6*a*, except that, instead of feeding the absolute value circuit 82, amplifier 80 follows the low-pass filter 84. In addition, a modified soft limiter 98 is interposed between EXP block 96 and multiplier 92. The output of the EXP block 90 is the gain of the system. The insertion of the soft limiter block 98 in the circuit of FIG. 7*a* limits the gain to the maximum value which is set to be the gain required to compensate for the hearing loss at threshold.

In a digital implementation, soft limiter 98 may be realized as a subroutine which provides an output to multiplier 92 equal to the input to soft limiter 98 for all values of input less than the value of the gain to be realized by multiplier 92 required to compensate for the hearing loss at threshold and provides an output to multiplier 92 equal to the value of the gain required to compensate for the hearing loss at threshold for all inputs greater than this value.

Those of ordinary skill in the art will recognize that multiplier 92 functions as a variable gain amplifier whose gain is set by the output of soft limiter 98. It is further convenient, but not necessary to modify the soft limiter 98 to limit the gain for soft sounds below threshold to be equal to or less than that required for hearing compensation at threshold. If the soft limiter 98 is so modified, then care must be taken to ensure that the gain below the threshold of hearing is not discontinuous with respect to a small change in input level.

Figure 7B:
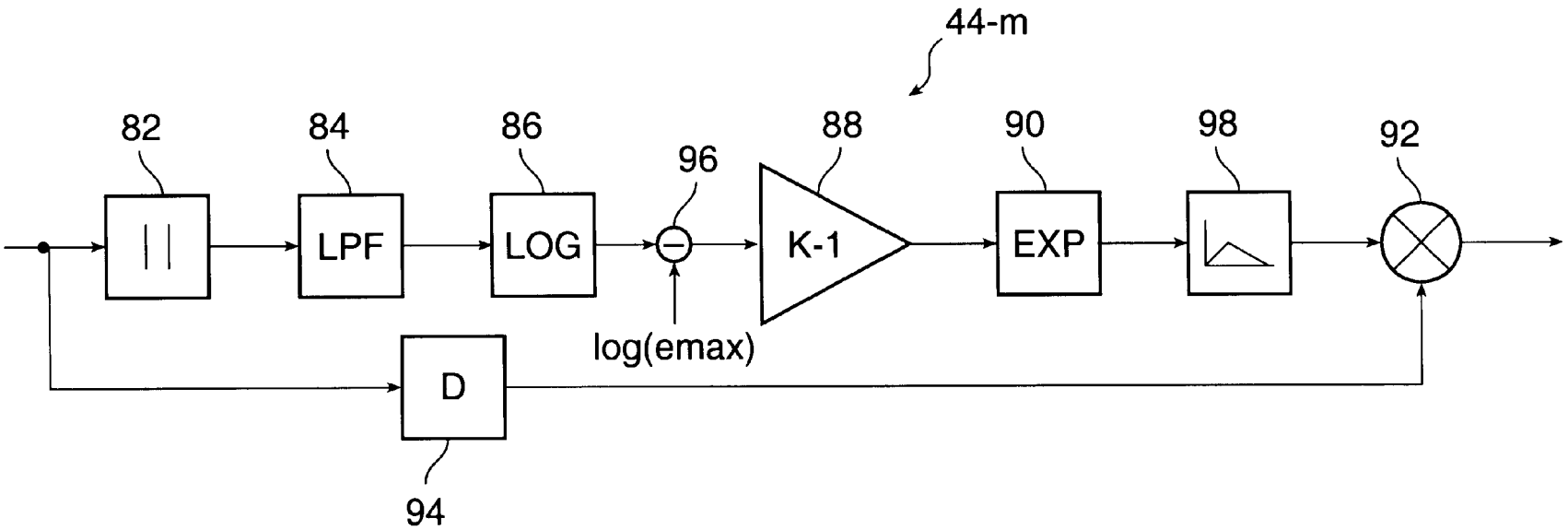
FIG. 7B is a block diagram of an alternate embodiment of the multiplicative AGC circuit of FIG. 7A.

FIG. 7*b* is a block diagram of a variation of the circuit shown in FIG. 7*a*. Those of ordinary skill in the art will recognize that amplifier 80 may be eliminated and its gain function may be realized equivalently by subtracting the value log $1/e_{max}$ from the output of log block 86 in subtractor circuit 96 as shown in FIG. 7*b* without deviating from the concepts herein.

The embodiments of FIGS. 4*a*, 4*b*, 6*a* and 6*b* correctly map acoustic stimulus intensities within the normal hearing range into an equivalent perception level for the hearing impaired, but they also provide increasing gain when the input stimulus intensity is below threshold. The increasing gain for sounds below threshold has the effect of introducing annoying noise artifacts into the system, thereby increasing the noise floor of the output. Use of the embodiment of FIGS. 7*a* and 7*b* with the modified soft limiter 98 in the processing stream eliminates this additional noise. Use of the modified soft limiter 98 provides another beneficial effect by eliminating transient overshoot in the system response to an acoustic stimulus which rapidly makes the transition from silence to an uncomfortably loud intensity.

The stabilization effect of the soft limiter 98 may also be achieved by introducing appropriate delay into the system, but this can have damaging side effects. Delayed speech transmission to the ear of one's own voice causes a feedback delay which can induce stuttering. Use of the modified soft limiter 98 eliminates the acoustic delay used by other techniques and simultaneously provides stability and an enhanced signal-to-noise ratio.

An alternate method for achieving stability is to add a low level (i.e., an intensity below the hearing threshold level) of noise to the inputs to the audio bandpass filters 42-1 through 42-m. This noise should be weighted such that its spectral shape follows the threshold-of-hearing curve for a normal hearing individual as a function of frequency. This is shown schematically by the noise generator 100 in FIG. 3. Noise generator 100 is shown injecting a low level of noise into each of audio bandpass filters 42-1 through 42-m. Numerous circuits and methods for noise generation are well known in the art.

The multiplicative AGC full range adaptive compression for hearing compensation differs from the earlier FFT work in several significant ways. The multi-band multiplicative AGC adaptive compression technique of the present invention does not employ frequency domain processing but instead uses time domain filters with similar or equivalent Q based upon the required critical bandwidth. In addition, in contrast to the FFT approach, the system of the present invention employing multiplicative AGC adaptive compression may be implemented with a minimum of delay and no explicit feedforward or feedback.

In the prior art FFT implementation, the parameter to be measured using this prior art technique was identified in the phon space. The presently preferred system of the present invention incorporating multi-band multiplicative AGC adaptive compression inherently includes recruitment phenomenalogically, and requires only the measure of threshold hearing loss and upper comfort level as a function of frequency.

Finally, the multi-band multiplicative AGC adaptive compression technique of the present invention utilizes a modified soft limiter 98 or alternatively a low level noise generator 100 which eliminates the additive noise artifact introduced by prior-art processing and maintains sound fidelity. However, more importantly, the prior-art FFT approach will become unstable during the transition from silence to loud sounds if an appropriate time delay is not used. The presently preferred multiplicative AGC embodiment of the present invention is stable without the use of this delay.

The multi-band, multiplicative AGC adaptive compression approach of the present invention has several advantages. First, only the threshold and upper comfort levels for the person being fitted need to be measured. The same lowpass filter design is used to extract the envelope, e(n), of the sound stimulus s(n), or equivalently the log (e(n)), for each of the frequency bands being processed. Further, by using this same filter design and simply changing the cutoff frequencies of the low-pass filters as previously explained, other applications may be accommodated including those where rapid transition from silence to loud sounds is anticipated.

The multi-band, multiplicative AGC adaptive compression approach of the present invention has a minimum time delay. This eliminates the auditory confusion which results when an individual speaks and hears their own voice as a direct path response to the brain and receives a processed delayed echo through the hearing aid system.

Normalization with the factor $e_{max}$, makes it mathematically impossible for the hearing aid to provide a gain which raises the output level above a predetermined upper comfort level, thereby protecting the ear against damage. For sound input levels greater than $e_{max}$ the device attenuates sound rather than amplifying it. Those of ordinary skill in the art will recognize that further ear protection may be obtained by limiting the output to a maximum safe level without departing from the concepts herein.

A separate exponential constant K is used for each frequency band which provides precisely the correct gain for all input intensity levels, hence, no switching between linear and compression ranges occurs. Switching artifacts are eliminated.

The multi-band, multiplicative AGC adaptive compression approach of the present invention has no explicit feedback or feedforward. With the addition of a modified soft limiter 98, stable transient response and a low noise floor is ensured. A significant additional benefit over the prior art which accrues to the present invention as a result of the minimum delay and lack of explicit feedforward or feedback in the multiplicative AGC is the amelioration of annoying audio feedback or regeneration typical of hearing aids which have both the hearing aid microphone and speaker within close proximity to the ear.

As pointed out above, there is no generalized law of Superposition for non-linear systems. According to another aspect of the present invention, it has been recognized for a specific class of signals, including sound, that the DSP may be non-linear and a differential representation of the sampled signal may be used and the additive property of the law of linear superposition may be applied to the system outputs. The class of signals to which the invention is directed are signals with slowly varying envelopes wherein the slowly varying envelope signal is oversampled.

As previously discussed, acoustical energy may be conceptualized as the product of two components. The first is the always positive slowly varying envelope and may be written as e(n), and the second is the rapidly varying carrier which may be written as v(n). The digital samples of sound are denoted s(n), wherein n is the sample index, and the total sound is expressed as:

$$s(n)=e(n)\cdot v(n)$$

According to the present invention, the slowly varying oversampled analog signal is the envelope signal e(t), wherein t represents time. The length of time between successive samples e(n) of the analog signal e(t) is denoted as T.

The operation of the multiband system of FIG. 3 using non-linear DSP processing is described as follows. In FIG. 3, the output from the differential A/D converter 14 is:

$$\Delta s(n)=s(n)-s(n-1) \tag{1}$$

Given that acoustical energy may be represented as s(n)=e(n)·v(n), the output from the differential A/D converter 14 may be written as:

$$\Delta s(n(=e(n)\cdot v(n)-e(n-1)\cdot v(n-1) \tag{2}$$

According to the present invention, the envelope, e(n), is obtained by lowpass filtering the signal Δs(n), wherein the envelope, e(n), is greatly oversampled. It is typical for the sample rate to be greater than 10 KHZ for a 16 Hz low-pass filter. Accordingly, as long as the error incurred by approximating the envelope sample e(n) by e(n−1) is significantly smaller than e(n) and the difference between adjacent samples is approximately a zero mean process, it is valid to make the assumption that:

$$e(n)\approx e(n-1) \tag{3}$$

As a consequence of substituting eq. (3) into eq. (2), it can be seen that:

$$\Delta s(n)\approx e(n)[v(n)-v(n-1)] \tag{4}$$

Now, eq. (4) implies that the output from the digital multiplicative AGC circuit in each channel, m, is:

$$\Delta y_m(n)\approx e_m{}^{a^m}[v_m(n)-v_m(n-1)] \tag{5}$$

It should be appreciated that the exponent, $a_m$, of the envelope portion $e_m$, may be derived as non-linear function. Alternatively, the entire function may be replaced with a table look-up.

With the above derivation using the slowly varying envelope, e(n), the summation of each of the channels, followed by the summation (integration) of all of the samples is as follows:

$$y(n)=\sum_{n_d=1}^{n}\sum_{m=1}^{M}\Delta y_m(n_d) \tag{6}$$

indicates that the reconstruction of the multiband system samples of the present invention is done as if the system were linear. The variables $n_d$, m, and M are the sample number of the differential signal sample, the channel number and the total number of channels, respectively.

If the integrator 18 and D/A converter 22 are omitted as suggested earlier and shown in FIG. 1B, the summation of the channels is as follows:

$$\Delta y(n)=\sum_{m=1}^{M}\Delta y_m(n) \tag{7}$$

According to another aspect of the present invention, an in-the-ear hearing compensation system employs two electrical signal-to-acoustical energy transducers. Two recent developments have made a dual-receiver hearing aid possible. The first is the development of miniaturized moving-coil transducers and the second is the critical-band compression technology disclosed herein and also disclosed and claimed in parent application Ser. No. 08/272,927 filed Jul. 8, 1994, now U.S. Pat. No. 5,500,902.

Figure 8:
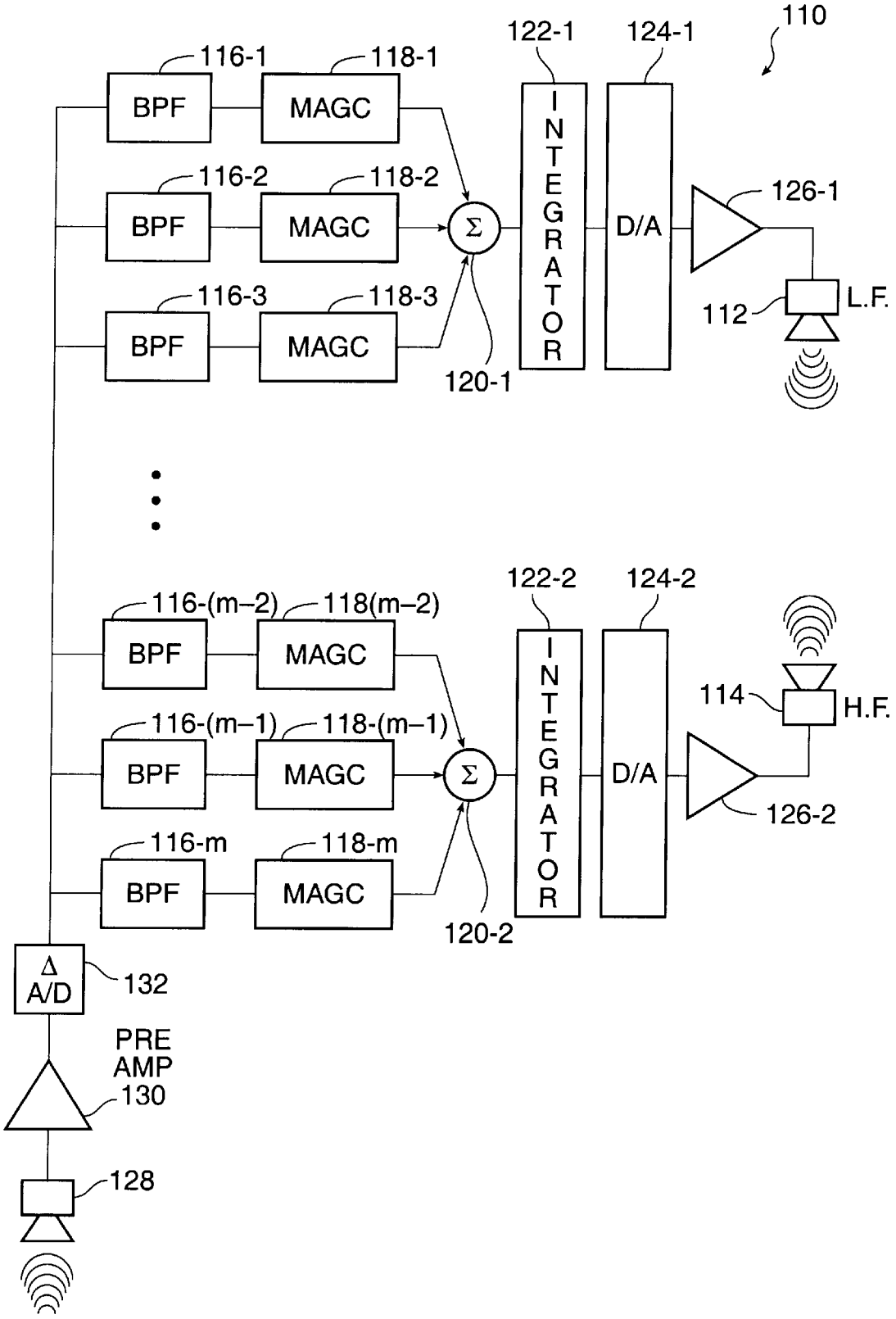
FIG. 8 is a block diagram of hearing compensation system having two electrical signal-to-acoustical energy transducers and employing differential signal sampling according to the present invention.

Referring now to FIG. 8, a block diagram of an in-the-ear hearing compensation system 110 employing two electrical-signal to acoustical-energy transducers is presented. A first electrical-signal to acoustical-energy transducer 112, such as a Knowles (or similar) conventional iron-armature hearing-aid receiver is employed for low frequencies (e.g., below 1 kHz) as a woofer, and a second electrical-signal to acoustical-energy transducer 114 such as a scaled moving-coil transducer is employed for high frequencies (e.g., above 1 kHz) as a tweeter. Both of these devices together can easily be fit into the ear canal.

Demand for high-fidelity headphones for portable electronic devices has spurred development of moving-coil transducers less than ½ inch diameter that provide flat response over the entire audio range (20–20,000 Hz). To fit in the ear canal, a transducer must be less than ¼ inch in diameter, and therefore the commercially available transducers are not applicable. A scaling of the commercial moving-coil headphone to 3/16 in diameter or less using rare-earth magnets yields a transducer that has excellent efficiency from 1 kHz to well beyond the upper frequency limit of human hearing.

The hearing compensation system 110 shown in FIG. 8 is conceptually identical to the embodiment shown in FIG. 3, except that the processing channels, each containing a bandpass filter and multiplicative AGC gain control, are divided into two groups. In hearing compensation system 110, an electret microphone transduces acoustical energy into an electrical signal, s(t), that is fed through preamplifier 130 to differential A/D converter 132. The output of differential A/D converter 132 is a differential signal sample, Δs(n). The first group, comprising bandpass filters 116-1, 116-2, and 116-3 and multiplicative AGC circuits 118-1, 118-2, and 118-3, processes signals with frequencies below the resonance of the iron-armature transducer 112. The second group, comprising bandpass filters 116-(m-2), 116-(m-1), and 116-m and multiplicative AGC circuits 118-(m-2), 118-(m-1), and 118-m processes signals above the resonance of the iron-armature transducer 112.

The outputs of the first group of processing channels are summed in summing element 120-1. Successive processed differential signal samples are then summed by integrator 122-1 whose output is fed through D/A converter 124-1 to power amplifier 126-1, which drives iron-armature transducer 112. The outputs of the second group of processing channels are summed in summing element 120-2. Successive processed differential signal samples are then summed by integrator 122-2 whose output is fed through D/A converter 124-2 to power amplifier 126-2, which drives scaled moving-coil transducer 114.

Using the arrangement shown in FIG. 8 where the frequency separation into high and low components is accomplished using the bandpass filters, no crossover network is needed, thereby simplifying the entire system. Persons of ordinary skill in the art will appreciate that processing and amplifying elements in the first group may be specialized for the frequency band over which they operate, as can those of the second group. This specialization can save considerable power dissipation in practice. Examples of such specialization include using power amplifiers whose designs are optimized for the particular transducer, using sampling rates appropriate for the bandwidth of each group, and other well-known design optimizations.

An alternative to a miniature moving-coil transducer for high-frequency transducer 114 has also been successfully demonstrated by the authors. Modern electrets have a high enough static polarization to make their electro-mechanical transduction efficiency high enough to be useful as high-frequency output transducers. Such transducers have long been used in ultrasonic applications, but have not been applied in hearing compensation applications. When these electret devices are used as the high-frequency transducer 64, persons of ordinary skill in the art will appreciate that the design specializations noted above should be followed, with particular emphasis on the power amplifier, which must be specialized to supply considerably higher voltage than that required by a moving-coil transducer.

Figure 9:
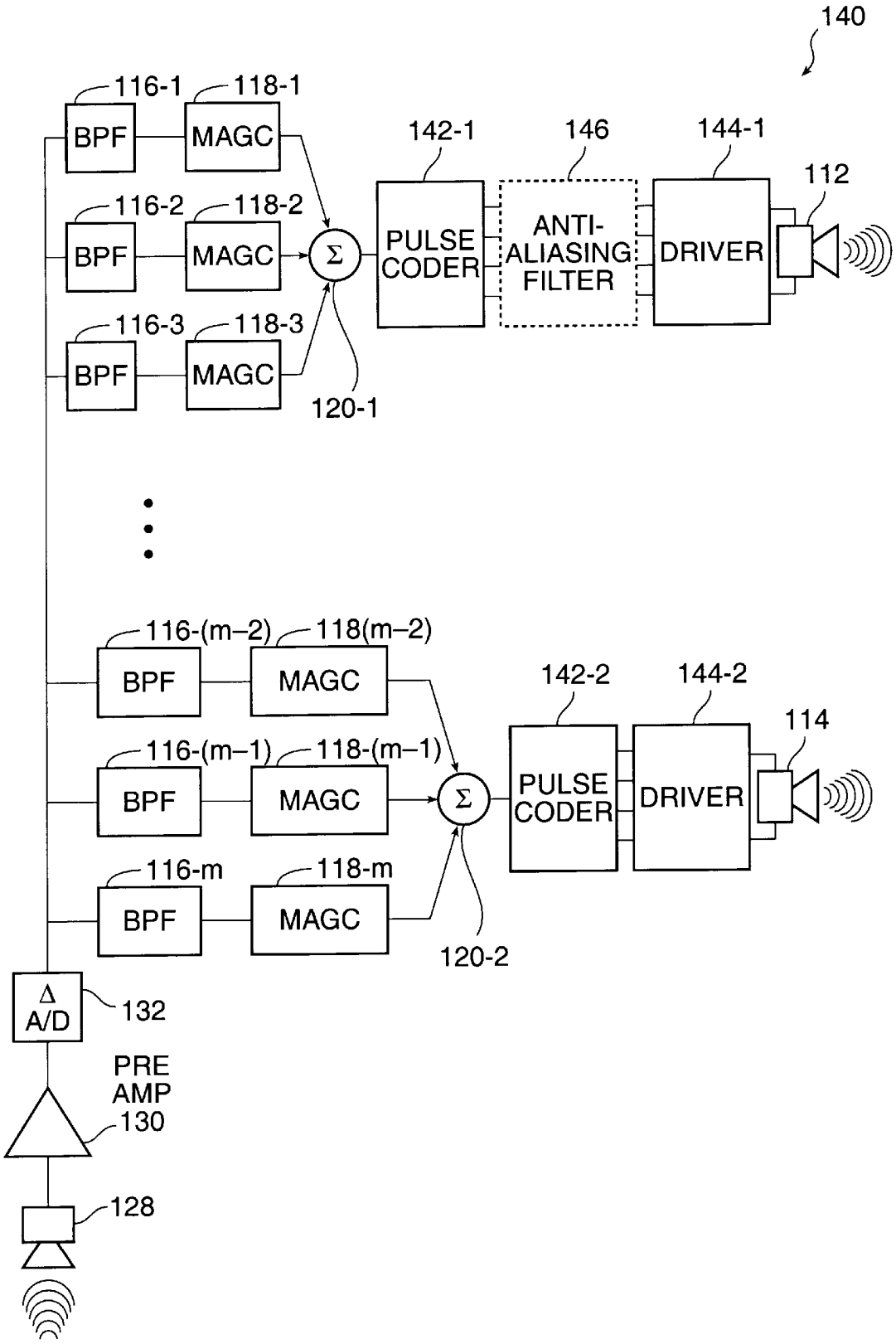
FIG. 9 is a block diagram of hearing compensation system having two electrical signal-to-acoustical energy transducers and employing differential signal sampling and output pulse width modulation according to the present invention.

As described above with reference to FIG. 1B, a positive or negative pulse width proportional to the differential output of the signal processing circuits 118 may be used to drive the output transducers 112 and 114. Illustrated in FIG. 9 is a hearing compensation system 140 wherein the integrators 122-1 and 122-2, D/A converters 124-1 and 124-2, and amplifiers 126-1 and 126-2 shown in FIG. 8 have been omitted. In hearing compensation system 140, pulse coders 142-1 and 142-2 are connected to connected to the outputs of summing elements 120-1 and 120-2, respectively. The outputs of pulse coders 142-1 and 142-2 are fed into driver amplifiers 144-1 and 144-2, and the outputs of the driver amplifiers 144-1 and 144-2 are connected to output transducers 112 and 114. The pulse coders 142-1 and 142-2, and driver amplifiers 144-1 and 144-2 are as described with reference to FIG. 1B. An anti-aliasing filter 146, shown by a dashed block, may be disposed between the pulse coder 142-1 and the driver amplifier 144-1 when the response of output transducer 112 is above the Nyquist rate. Implementations of anti-aliasing filter 146 are well known to those of ordinary skill in the art and will not be disclosed herein.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A hearing compensation system comprising:

an input transducer for converting acoustical information at an input thereof to electrical signals at an output thereof;

a differential analog-to-digital converter sampling said electrical signals output from said input transducer at an input thereof and outputting differential signal samples at an output thereof as digital signals, said differential signal samples representing the difference between successive samples of said electrical signals;

a digital signal processing circuit having an input connected to said output of said differential analog-to-digital converter and operating on said differential signal samples to form processed differential signal samples at an output thereof;

an integrator having an input connected to said output of said digital signal processing circuit to form a sum of successive ones from said processed differential signal samples at an output thereof;

a digital-to-analog converter having an input connected to said output of said integrator to form an analog signal from said sum of said successive ones of said processed differential signal samples at an output thereof; and an output transducer having an input connected to said output of said digital-to-analog converter to convert said analog signal from said digital-to-analog converter to acoustical information at an output thereof.

2. A hearing compensation system comprising:

an input transducer for converting acoustical information at an input thereof to electrical signals at an output thereof;

a differential analog-to-digital converter sampling said electrical signals output from said input transducer at an input thereof and outputting differential signal samples at an output thereof as digital signals, said differential signal samples representing the difference between successive samples of said electrical signals;

a plurality of bandpass filters, each bandpass filter having an input connected to said output of said differential analog-to-digital converter to separate said differential signal samples according to frequency;

a plurality of digital signal processing circuits, each individual digital signal processing circuit having an input connected to a different one of said plurality of bandpass filters and an output summed with said outputs of all other ones of said digital signal processing circuits to form processed differential signal samples;

an integrator having an input connected to said processed differential signal samples from said plurality of digital signal processing circuits to form a sum of successive ones of said processed differential signal samples at an output thereof;

a digital-to-analog converter having an input connected to said output of said integrator to form an analog signal from said sum of said successive ones of said processed differential signal samples at an output thereof; and an output transducer having an input connected to said output of said digital-to-analog converter to convert said analog signal from said digital-to-analog converter to acoustical information at an output thereof.

3. A hearing compensation system comprising:

an input transducer for converting acoustical information at an input thereof to electrical signals at an output thereof;

a differential analog-to-digital converter sampling said electrical signals output from said input transducer at an input thereof and outputting differential signal samples at an output thereof as digital signals, said differential signal samples representing the difference between successive samples of said electrical signals;

a first plurality of bandpass filters, said first plurality of bandpass filters for filtering electrical signals below a crossover frequency, each bandpass filter having an input connected to said output of said differential analog-to-digital converter to separate said differential signal samples according to frequency;

a second plurality of bandpass filters, said second plurality of bandpass filters for filtering electrical signals above said crossover frequency, each bandpass filter having an input connected to said output of said differential analog-to-digital converter to separate said differential signal samples according to frequency;

a first plurality of digital signal processing circuits, each individual digital signal processing circuit in said first plurality of digital signal processing circuits having an input connected to a different one of said first plurality of bandpass filters and an output summed with said outputs of all other ones of said first plurality of digital signal processing circuits to form first processed differential signal samples;

a second plurality of digital signal processing circuits, each individual digital signal processing circuit in said second plurality of digital signal processing circuits having an input connected to a different one of said second plurality of bandpass filters and an output summed with said outputs of all other ones of said second plurality of digital signal processing circuits to form second processed differential signal samples;

a first integrator having an input connected to said first processed differential signal samples from said first plurality of digital signal processing circuits to form a first sum of successive ones of said processed differential signal samples at an output thereof;

a second integrator having an input connected to said second processed differential signal samples from said second plurality of digital signal processing circuits to form a second sum of successive ones of said processed differential signal samples at an output thereof;

a first digital-to-analog converter having an input connected to said output of said first integrator to form a first analog signal from said first sum of said successive ones of said first processed differential signal samples at an output thereof;

a second digital-to-analog converter having an input connected to said output of said second integrator to form a second analog signal from said second sum of said successive ones of said second processed differential signal samples at an output thereof;

a first output transducer for converting electrical signals below said crossover frequency having an input connected to said output of said first digital-to-analog converter to convert said first analog signal from said first digital-to-analog converter to acoustical information at an output thereof; and a second output transducer for converting electrical signals above said crossover frequency having an input connected to said output of said second digital-to-analog converter to convert said second analog signal from second first digital-to-analog converter to acoustical information at an output thereof.

4. The system of claim 3 wherein said first output transducer is an iron-armature transducer.

5. The system of claim 4 wherein said first plurality of bandpass filters pass frequencies in a frequency band below a lowest resonant frequency of said iron-armature transducer.

6. The systems of claim 4 wherein said second plurality of bandpass filters pass frequencies in a frequency band above a lowest resonant frequency of said iron-armature transducer.

7. The system of claim 3 wherein said second output transducer is a moving coil transducer.

8. The system of claim 3 wherein said second output transducer is an electret transducer.

9. The system of claim 3 wherein said crossover frequency is approximately 1 kHz.

10. The systems of claim 3 further including a noise generator connected to inject a selected amount of noise into said inputs of each of said first plurality of bandpass filters and into said inputs of each of said second plurality of bandpass filters, said noise weighted such that its spectral shape follows the threshold-of-hearing curve of a normal hearing individual as a function of frequency.

11. The hearing compensation system of claim 3 wherein the number of said first and second pluralities of said bandpass filters, and the number of said first and second pluralities of said digital processing circuits, is from 9 to 15.

12. A hearing compensation system comprising:

an input transducer for converting acoustical information at an input thereof to electrical signals at an output thereof;

a differential analog-to-digital converter sampling said electrical signals output from said input transducer at an input thereof and outputting differential signal samples at an output thereof as digital signals, said differential signal samples representing the difference between successive samples of said electrical signals;

a digital signal processing circuit having an input connected to said output of said differential analog-to-digital converter and operating on said differential signal samples to form processed differential signal samples at an output thereof;

a pulse coder having an input connected to said processed differential signal samples of said digital signal processing circuit to form an output pulse for each of said processed differential signal samples, said output pulse having a duration proportional to the magnitude of each of said processed differential signal samples at an output thereof;

a driver amplifier having an input connected to said output of said pulse coder to form a driving voltage having a duration proportional to said duration of said output pulse from said pulse coder at an output thereof; and an output transducer having an input connected to said output of said driver amplifier to convert said driving voltage from said driver amplifier to acoustical information at an output thereof.

13. The hearing compensation system of claim 12 wherein said driving voltage has a magnitude and a sign, said sign corresponding to a sign of said differential signal samples.

14. A hearing compensation system comprising:

an input transducer for converting acoustical information at an input thereof to electrical signals at an output thereof;

a differential analog-to-digital converter sampling said electrical signals output from said input transducer at an input thereof and outputting differential signal samples at an output thereof as digital signals, said differential signal samples representing the difference between successive samples of said electrical signals;

a plurality of bandpass filters, each bandpass filter having an input connected to said output of said differential analog-to-digital converter to separate said differential signal samples according to frequency into a plurality of filtered differential signal samples;

a plurality of digital signal processing circuits, each individual digital signal processing circuit having an input connected to a different one of said plurality of bandpass filters and an output summed with said outputs of all other ones of said digital signal processing circuits, wherein each individual digital signal processing circuit operates on one of said filtered differential signal samples to form processed differential signal samples;

a pulse coder having an input connected to said processed differential signal samples of said plurality of digital signal processing circuits to form an output pulse for each of said processed differential signal samples, said output pulse having a duration proportional to the magnitude of each of said processed differential signal samples at an output thereof;

a driver amplifier having an input connected to said output of said pulse coder to form a driving voltage having a duration proportional to said duration of said output pulse from said pulse coder at an output thereof; and an output transducer having an input connected to said output of said driver amplifier to convert said output of said driver amplifier to acoustical information at an output thereof.

15. The hearing compensation system of claim 14 wherein said driving voltage has a magnitude and a sign, said sign corresponding to a sign of said differential signal samples.

16. A hearing compensation system comprising:

an input transducer for converting acoustical information at an input thereof to electrical signals at an output thereof;

a differential analog-to-digital converter sampling said electrical signals output from said input transducer at an input thereof and outputting differential signal samples at an output thereof as digital signals, said differential signal samples representing the difference between successive samples of said electrical signals;

a first plurality of bandpass filters, said first plurality of bandpass filters for filtering electrical signals below a crossover frequency, each bandpass filter having an input connected to said output of said differential analog-to-digital converter to separate said differential signal samples according to frequency;

a second plurality of bandpass filters, said second plurality of bandpass filters for filtering electrical signals above said crossover frequency, each bandpass filter having an input connected to said output of said differential analog-to-digital converter to separate said differential signal samples according to frequency;

a first plurality of digital signal processing circuits, each individual digital signal processing circuit in said first plurality of digital signal processing circuits having an input connected to a different one of said first plurality of bandpass filters and an output summed with said outputs of all other ones of said first plurality of digital signal processing circuits to form first processed differential signal samples;

a second plurality of digital signal processing circuits, each individual digital signal processing circuit in said second plurality of digital signal processing circuits having an input connected to a different one of said second plurality of bandpass filters and an output summed with said outputs of all other ones of said second plurality of digital signal processing circuits to form second processed differential signal samples;

a first pulse coder having an input connected to said first processed differential signal samples from said first plurality of digital signal processing circuits to form a first output pulse for each of said first processed differential signal samples, said first output pulse having a duration proportional to the magnitude of said first processed differential signal samples at an output thereof;

a second pulse coder having an input connected to said second processed differential signal samples from said second plurality of digital signal processing circuits to form a second output pulse for each of said second processed differential signal samples, said second output pulse having a duration proportional to the magnitude of said second processed differential signal samples at an output thereof;

a first driver amplifier having an input connected to said output of said first pulse coder to form a first driving voltage having a duration proportional to said duration of said first output pulse from said first pulse coder at an output thereof;

a second driver amplifier having an input connected to said output of said second pulse coder to form a second driving voltage having a duration proportional to said duration of said second output pulse from said second pulse coder at an output thereof;

a first output transducer for converting electrical signals below said crossover frequency having an input connected to said output of said first driver amplifier to convert said first driving voltage from said first driver amplifier to acoustical information at an output thereof; and a second output transducer for converting electrical signals above said crossover frequency having an input connected to said output of said second driver amplifier to convert said second driving voltage from said second driver amplifier to acoustical information at an output thereof.

17. The system of claim 16 wherein said first output transducer is an iron-armature transducer.

18. The system of claim 17 wherein said first plurality of bandpass filters pass frequencies in a frequency band below a lowest resonant frequency of said iron-armature transducer.

19. The systems of claim 17 wherein said second plurality of bandpass filters pass frequencies in a frequency band above a lowest resonant frequency of said iron-armature transducer.

20. The system of claim 16 wherein said second output transducer is a moving coil transducer.

21. The system of claim 16 wherein said second output transducer is an electret transducer.

22. The system of claim 16 wherein said crossover frequency is approximately 1 kHz.

23. The systems of claim 16 further including a noise generator connected to inject a selected amount of noise into said inputs of each of said first plurality of bandpass filters and into said inputs of each of said second plurality of bandpass filters, said noise weighted such that its spectral shape follows the threshold-of-hearing curve of a normal hearing individual as a function of frequency.

24. The hearing compensation system of claim 16 wherein the number of said first and second pluralities of said bandpass filters, and the number of said first and second pluralities of said digital processing circuits, is from 9 to 15.

25. The hearing compensation system of claim 16 wherein said driving voltage has a magnitude and a sign, said sign corresponding to a sign of said differential signal samples.

26. A differential signal output driver, comprising:

a pulse coder having an input connected to a differential signal sample to form an output pulse for said differential signal sample, said output pulse having a duration proportional to the magnitude of said differential signal sample at an output thereof;

a driver amplifier having an input connected to said output of said pulse coder to form a driving voltage having a duration proportional to said duration of said output pulse from said pulse coder at an output thereof; and an output transducer having an input connected to said output of said driver amplifier to convert said output of said driver amplifier to acoustical information at an output thereof.

27. The differential signal output driver of claim 26 wherein said driver amplifier includes first and second P-channel MOS transistors having a source, a drain, and a gate, and first and second N-channel MOS transistors having a source, a drain, and a gate, said sources of said first and second P-channel MOS transistors connected to a positive voltage supply rail, said sources of said first and second N-channel MOS transistors connected to a negative voltage supply rail, said drain of said first P-channel MOS transistor connected to said drain of said first N-channel MOS transistor to form a common node connected to a first input of said output transducer, and said drain of said second P-channel MOS transistor connected to said drain of said second N-channel MOS transistor to form a common node connected to a second input of said output transducer.

* * * * *

UNITED STATES PATENT AND TRADEMARK OFFICE

CERTIFICATE OF CORRECTION

PATENT NO. : 6,044,162

DATED : March 28, 2000

INVENTOR(S) : Carver A. Mead, Douglas M. Chabries, and Keith L. Davis

It is certified that error appears in the above-identified patent and that said Letters Patent is hereby corrected as shown below:

On column 5, line 54, please replace "Differential AND" with --Differential A/D-- .

On column 17, line 17, please replace equation (2) "$\Delta s(n( = e(n)\cdot v(n) - e(n-1)\cdot v(n-1)$" with -- $\Delta s(n) = e(n)\cdot v(n) - e(n-1)\cdot v(n-1)$--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*